US007464731B2

(12) United States Patent
Fujisawa

(10) Patent No.: US 7,464,731 B2
(45) Date of Patent: Dec. 16, 2008

(54) INDUSTRIAL TWO-LAYER FABRIC

(75) Inventor: Shigenobu Fujisawa, Shizuoka (JP)

(73) Assignee: Nippon Filcon Co. Ltd., Tokyo (JP)

( * ) Notice: Subject to any disclaimer, the term of this patent is extended or adjusted under 35 U.S.C. 154(b) by 0 days.

(21) Appl. No.: 11/586,506

(22) Filed: Oct. 26, 2006

(65) Prior Publication Data

US 2007/0095417 A1 May 3, 2007

(30) Foreign Application Priority Data

Oct. 31, 2005 (JP) ..... 2005-315749

(51) Int. Cl.
*D21F 7/08* (2006.01)
*D21F 7/10* (2006.01)
*D03D 25/00* (2006.01)

(52) U.S. Cl. ..... 139/383 A; 139/383 AA; 162/358.2; 162/349; 162/901; 162/903

(58) Field of Classification Search ..... 139/383 A; 162/358.2, 349, 900, 901, 903
See application file for complete search history.

(56) References Cited

U.S. PATENT DOCUMENTS 4,499,927 A * 2/1985 Borel ..... 139/425 A
4,564,052 A * 1/1986 Borel ..... 139/425 A
5,555,917 A * 9/1996 Quigley ..... 139/383 A
5,826,627 A * 10/1998 Seabrook et al. ..... 139/383 A
5,829,489 A * 11/1998 Kuji ..... 139/383 A
6,202,705 B1 * 3/2001 Johnson et al. ..... 139/383 A
6,240,973 B1 * 6/2001 Stone et al. ..... 139/383 A
6,334,467 B1 * 1/2002 Barrett et al. ..... 139/383 A
6,581,645 B1 * 6/2003 Johnson et al. ..... 139/383 A
6,810,917 B2 * 11/2004 Stone ..... 139/383 A
6,854,488 B2 * 2/2005 Hay et al. ..... 139/383 A
6,959,737 B2 * 11/2005 Ward ..... 139/383 A
6,978,809 B2 * 12/2005 Quigley ..... 139/383 A
7,001,489 B2 * 2/2006 Taipale et al. ..... 162/348
7,007,722 B2 * 3/2006 Quigley et al. ..... 139/383 A
7,059,357 B2 * 6/2006 Ward ..... 139/348
7,059,359 B2 * 6/2006 Quigley et al. ..... 139/383 A
7,059,361 B1 * 6/2006 Hansson ..... 139/383 A
7,073,539 B2 * 7/2006 Takimoto et al. ..... 139/383 A (Continued)

FOREIGN PATENT DOCUMENTS

JP 2003-342889 A 12/2003

*Primary Examiner*—Bobby H Muromoto, Jr.
(74) *Attorney, Agent, or Firm*—Rader, Fishman & Grauer, PLLC

(57) ABSTRACT

An industrial two-layer fabric having a lower surface structure excellent in water drainage property, fiber supporting property, rigidity and wear resistance, obtained by binding an upper layer fabric and a lower layer fabric, wherein each of lower surface side wefts has a design in which it passes over one lower surface side warp, passes under one lower surface side warp, passes over one lower surface side warp and then passes under five successive lower surface side warps, while lower surface side warps each has a design in which it passes over four successive lower surface side wefts, passes under one lower surface side weft, passes over three successive lower surface side wefts, passes under one lower surface side weft, passes over two successive lower surface side wefts, passes under one lower surface side weft, passes over three successive lower surface side wefts and then passes under one lower surface side weft.

9 Claims, 12 Drawing Sheets

U.S. PATENT DOCUMENTS

| | | | | |
|---|---|---|---|---|
| 7,216,677 | B2 * | 5/2007 | Fujisawa | 139/383 A |
| 7,270,151 | B2 * | 9/2007 | Nagura et al. | 139/383 A |
| 7,270,152 | B2 * | 9/2007 | Ueda et al. | 139/383 A |
| 7,306,014 | B2 * | 12/2007 | Nagura et al. | 139/383 A |
| 2003/0024590 | A1 * | 2/2003 | Stone | 139/408 |
| 2003/0178087 | A1 * | 9/2003 | Odenthal | 139/383 A |
| 2003/0217782 | A1 | 11/2003 | Nagura et al. | |
| 2004/0079434 | A1 * | 4/2004 | Martin et al. | 139/383 A |
| 2004/0118473 | A1 * | 6/2004 | Hay et al. | 139/383 R |
| 2004/0182464 | A1 | 9/2004 | Ward | |

* cited by examiner

PRIOR ART

INDUSTRIAL TWO-LAYER FABRIC

BACKGROUND OF THE INVENTION

The present invention relates to industrial two-layer fabrics excellent in rigidity, water drainage property, wear resistance, fiber supporting property and yield, and can be used for a long period of time.

Fabrics woven by warps and wefts have conventionally been used widely as an industrial fabric. They are, for example, used in various fields including papermaking wires, conveyor belts and filter cloths so that they are required to have fabric properties suited for the intended use or using environment. Particularly, papermaking fabrics used in a paper making step for removing water from raw materials by making use of the network of the fabric must satisfy a severe demand. There is therefore a demand for the development of fabrics which do not transfer a wire mark of the fabric to paper and therefore have excellent surface property, have dehydration property for sufficiently removing extra water contained in the raw materials, have enough rigidity and wear resistance and therefore are usable desirably even under severe environments, and are capable of maintaining conditions necessary for making good paper for a prolonged period of time. In addition, fiber supporting property, improvement in a papermaking yield, dimensional stability and running stability are demanded. In recent years, owing to the speed-up of a papermaking machine, requirements for papermaking fabrics become more severe.

Since most of the demands for industrial fabrics and solutions thereof can be understood if papermaking fabrics on which the most severe demand is imposed will be explained, the present invention will hereinafter be described by using the papermaking fabric as a typical example.

Papermaking raw materials are supplied on the upper side layer of a papermaking fabric so that the upper side layer is preferably dense and excellent in fiber supporting property and surface property. The lower side layer, on the other hand, becomes a surface with which a machine is brought into contact so that the lower side layer is preferably excellent in wear resistance, rigidity and water drainage property. It is said that an upper side layer has preferably a design in which a predetermined pattern is repeated regularly, but the design of a lower side layer is under investigation.

As a design of the lower side layer, various ones have been disclosed. For example, there is a ribbed fabric in which two adjacent lower surface side warps simultaneously pass over one lower surface side weft and under one lower surface side weft alternately as disclosed in Japanese Patent Laid-Open No. 2003-342889. The fabric having this design is excellent in water drainage property because a diagonal space is formed therein and in addition, it has an improved fiber supporting property on the surface because the shooting number of wefts can be increased. A crimp of lower surface side wefts which is brought into contact with a machine or roll is however short and does not protrude sufficiently so that a wear resistant volume of this fabric is small, which results in a problem of short lifetime.

A fabric developed to overcome the above-described problem is shown in Example 9 of FIG. 9 of US 2004/0079434. This fabric has improved wear resistance by forming a long crimp of lower surface side wefts in order to eliminate the above-described defect in the ribbed weave design. In this fabric, two adjacent warps have the same design as in the ribbed weave, but they have each a design in which a warp passes under one lower surface side weft and then passes over a plurality of lower surface side wefts adjacent to one another.

The crimp of lower surface side wefts can therefore be made longer. However, this fabric also has a problem. Compared with the fabric of a ribbed weave design, this fabric has less weaving positions, which reduces its rigidity. In addition, wefts cannot be fixed firmly and undesirable movement occurs owing to a too long crimp of lower surface side wefts. As a result, the fabric does not have greatly improved lifetime in spite of an increase in the wear resistant volume of wefts.

A fabric having improved rigidity is shown in Example of US 2004/0182464. A lower surface side warp approaches lower surface side warps right adjacent and left adjacent thereto successively and is thus disposed in a zigzag manner so that the fabric has improved rigidity, but the undesirable movement of wefts cannot be prevented because of a too long crimp.

A fabric having a crimp of an adequate length while maintaining rigidity is considered. The fabric has, as shown in Conventional Example 1 and FIGS. 23 and 24 in this specification, a design of lower surface side wefts in which each passes over one lower surface side warp, passes under one lower surface side warp, passes over one lower surface side warp, and then passes under five successive lower surface side warps. When such a design is employed, the fabric has excellent rigidity because of an increase in weaving positions, is therefore firmly woven without undesirable movement of wefts, and has excellent wear resistance. Lower surface side warps of the fabric formed by shifting the design of the lower surface side weft by five warps each has a design in which it passes under one lower surface side weft, passes over one lower surface side weft, passes under one lower surface side weft and then passes over five successive lower surface side wefts so that the lower surface side weft over which the lower surface side warp passes is pushed to the reverse side of the fabric. As a result, wear of this portion precedes wear of the other portion. Owing to subsequent breakage, the fabric becomes unsuited for practical use. In short, although a fabric excellent in rigidity and free of undesirable movement of wefts can be obtained, wear resistance is not sufficient owing to partially uneven wear.

A papermaking fabric capable of satisfying such severe demands has not yet been developed.

SUMMARY OF THE INVENTION

An object of the present invention is to provide an industrial two-layer fabric which has a lower surface side structure excellent in water drainage property, fiber supporting property, rigidity and wear resistance.

The present invention relates to an industrial two-layer fabric, which comprises eight pairs of an upper surface side warp and a lower surface side warp arranged vertically and a plurality of upper surface side wefts and lower surface side wefts. The eight upper surface side warps and the plurality of upper surface side wefts are woven to form an upper side layer. The eight lower surface side warps and the plurality of lower surface side wefts are woven to form a lower side layer, and the upper side layer and lower side layer being bound by a pair of two warps or two wefts. Each of the lower surface side wefts has a design in which the weft passes over one lower surface side warp, passes under one lower surface side warp, passes over one lower surface side warp and passes under five successive lower surface side warps. Each of the lower surface side warps has a design in which the warp passes over four successive lower surface side wefts, passes under one lower surface side weft, passes over three successive lower surface side wefts, passes under one lower surface side weft, passes over two successive lower surface side wefts, passes under one lower surface side weft, passes over three successive lower surface side wefts and passes under one lower surface side weft.

All the lower surface side wefts may constitute the lower side layer. In this case, each of the lower surface side wefts may have a design in which the lower surface side weft passes over one lower surface side warp, under one lower surface side warp, over one lower surface side warp and under five successive lower surface side warps. Thus, the lower side layer has a complete design or a repeating unit formed by disposing the lower surface side wefts one after another while shifting the design of the lower surface side weft by one warp, four warps, one warp and four warps successively.

In another case where all the lower surface side wefts constitute the lower side layer, each of the lower surface side wefts may have a design in which each lower surface side weft passes over one lower surface side warp, under one lower surface side warp, over one lower surface side warp and then under five successive lower surface side warps. Thus the lower side layer has a complete design or a repeating unit formed by disposing the lower surface side wefts one after another while shifting the design of the lower surface side weft by three warps, four warps, three warps and four warps successively.

Yet another case where all the lower surface side wefts constitute the lower side layer, each of the lower surface side wefts may have a design in which each lower surface side weft passes over one lower surface side warp, under one lower surface side warp, over one lower surface side warp and then under five successive lower surface side warps and the lower side layer has a complete design formed by disposing the lower surface side wefts one after another while shifting the design of the lower surface side weft by one warp, four warps, five warps, four warps, one warp, four warps, five warps and four warps successively.

At least one of the warp pairs composed of an upper surface side warp and one lower surface side warp may be a pair of binding warps at least one of which is a warp binding yarn for weaving a upper surface side weft and lower surface side weft to bind the upper side layer and lower side layer while forming a portion of the upper side layer and lower side layer.

In this case, the pair of binding warps may be composed of two warp binding yarns, a warp binding yarn and an upper surface side warp, or a warp binding yarn and one lower surface side warp, and the two warps forming the pair cooperatively form a design corresponding to one warp on the upper side surface and lower side surface.

Two binding yarns forming a pair and weaving the upper side layer and lower side layer may be weft binding yarns which are located between wefts and weave the upper side warp with the lower side warp while forming a portion of the upper side surface. The upper surface side wefts and lower surface side wefts may be arranged at a ratio of from 1:1 to 2:1. The upper side layer may have any one of plain weave, twill weave and sateen weave designs.

The industrial two-layer fabric according to the present invention which is free from partially uneven wear and having excellent water drainage property, fiber supporting property and the like can be obtained by shifting, with certain regularity, the design of one lower surface side weft having rigidity and wear resistance.

DETAILED DESCRIPTION OF THE INVENTION

Figure 1:
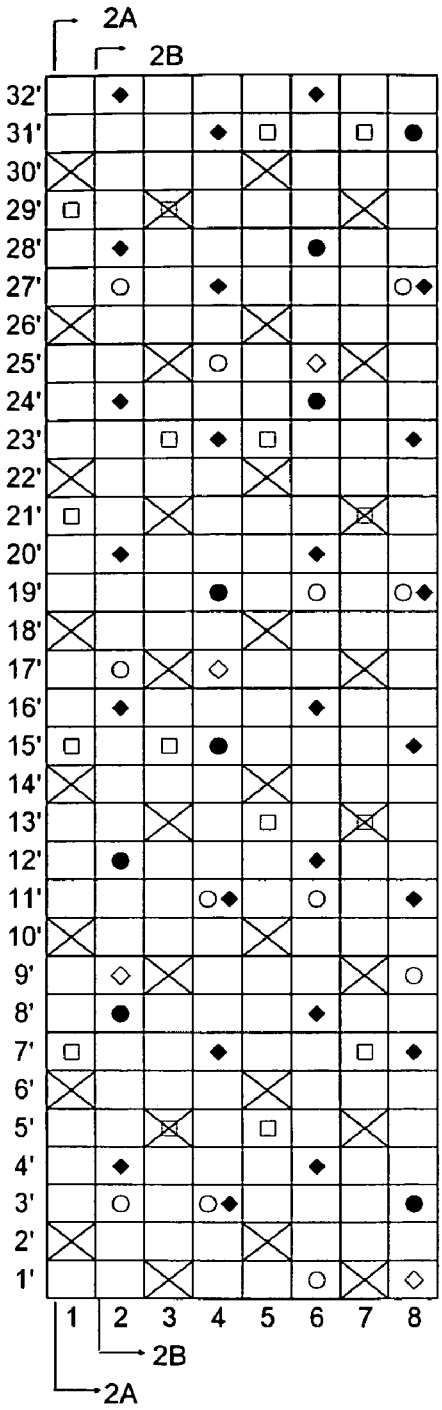
FIG. 1 is a design diagram of an industrial two-layer fabric according to Example 1 of the present invention.

The industrial fabric according to the present invention has an upper side layer woven by eight upper surface side warps and a plurality of upper surface side wefts and a lower side layer woven by eight lower surface side warps and a plurality of lower surface side wefts. The eight upper surface side warps and the eight lower surface side warps are arranged vertically and form eight warp pairs. The upper side layer and lower side layer are bound via warps or wefts. The lower surface side wefts each has a design in which it passes over one lower surface side warp, under one lower surface side warp, over one lower surface side warp, and under five successive lower surface side warps. The lower surface side warps each has a 4/1-3/1-2/1-3/1 design in which it passes over four successive lower surface side wefts, under one lower surface side weft, over three successive lower surface side wefts, under one lower surface side weft, two successive lower surface side wefts, under one lower surface side weft, over three successive lower surface side wefts and under one lower surface side weft.

The design of the upper side layer is not limited and it may be any one of plain weave, twill weave and sateen weave designs. A complete design obtained using any one of them may be connected in four directions, whereby an industrial two-layer fabric excellent in diagonal rigidity, running stability and wear resistance can be obtained.

The term "warp pair" as used herein means a pair of an upper surface side warp and a lower surface side warp arranged vertically. The upper surface side warp is woven with an upper surface side weft and the lower surface side warp is woven with a lower surface side weft. In each of the warp pairs, the upper surface side warp and lower surface side warp are arranged almost vertically and eight warp pairs constitute a complete design.

A binding yarn for weaving the upper side layer and lower side layer may be either a warp or a weft. When the binding yarn is a warp, a warp binding yarn for weaving and binding an upper surface side weft and a lower surface side weft while forming a portion of the upper side layer and lower surface side layer is used as at least one of the warps constituting the warp pair. The warp pair having, as a constituent warp, at least one warp binding yarn is called "binding warp pair" herein and the binding warp pair may be used as at least one pair, of the eight pairs constituting the complete design. For example, when one binding warp pair is disposed, the number of warp pairs is seven, while two binding warp pairs are disposed, the number of warp pairs is six.

Examples of the "binding warp pair" include a pair of two warp binding yarns, a pair of an upper surface side warp and a warp binding yarn, and a pair of a lower surface side warp and a warp binding yarn. In any pair, at a position where one of the pair passes over an upper surface side weft to form a surface, the other one is disposed between the upper surface side weft and a lower surface side weft or under the lower surface side weft. At a position where one of the pair passes under a lower surface side weft to form a lower side surface, the other one is disposed between an upper surface side weft and the lower surface side weft or over the upper surface side weft. As a result, the binding warp pair forms a design corresponding to one warp on both of the upper side surface and lower side surface. When an upper surface side warp forms a 1/1 design, the binding warp pair may also have a 1/1 design. Since a lower surface side warp has a 4/1-3/1-2/1-3/1 design, the binding warp pair may also have a 4/1-3/1-2/1-3/1 design. The design of the binding warp pair by using two warps can be selected as needed and there are many combinations. It may be determined, depending on the design of upper and lower layers.

In the lower side layer of the fabric of the present invention, a lower surface side weft forms a design in which it passes over a lower surface side warp, under a lower surface side warp, over one lower surface side warp, and under five successive lower surface side warps. When a binding yarn pair is employed as at least one of warp pairs, the term "a lower surface side warp" as used herein must sometimes be interpreted as "a warp binding yarn of a binding warp pair". For example, in the case of a fabric in which a warp pair and a binding warp pair composed of two binding warps are arranged alternately, a lower surface side weft has a design in which it passes over a lower surface side warp, under a binding warp, over one lower surface side warp, and under five binding warps and lower surface side warps which have been successively and alternately arranged.

No particular limitation is imposed on an arrangement ratio of warp pairs and binding warp pairs. Warp pairs and four binding warp pairs may be arranged, for example, at 4:4, 2:6 or 1:7. All of the warp pairs may be a binding warp pair. What is required in this invention is arrangement of at least one binding warp pair.

When a binding yarn is a weft, "weft binding yarns constituting a pair" for weaving the upper side layer with the lower side layer may be disposed between wefts. The weft binding yarns have both a function as a binding yarn for weaving an upper surface side warp and a lower surface side warp and a function as an upper surface side weft. Under a position where one of two weft binding yarns is woven with an upper surface side warp, the other weft binding yarn is woven with a lower surface side warp. In such a manner, the weft binding yarns can form, on the upper side surface, a surface design similar to that formed by upper surface side wefts. If an upper surface side warp forms a 1/1 design, the binding warp pair may have a 1/1 design. A plain weave design can be formed on the upper side surface by repeating this design. The surface becomes more even by adjusting the diameter of weft biding yarns equal to that of upper surface side wefts. Weft binding yarns usually have a smaller diameter than lower surface side wefts. It is recommended to employ, for the lower side layer, a design capable of preventing appearance of weft binding yarns from the lower side surface. A design and diameter which does not easily cause wear are preferably employed because rupture of weft binding yarns causes exfoliation between the upper and lower side layers.

The fabric of the present invention is composed of an upper side layer and a lower side layer. A lower surface side warp constituting a lower side layer has a 4/1-3/1-2/1-3/1 design in which it passes over four successive lower surface side wefts, under one lower surface side weft, over three successive lower surface side wefts, under one lower surface side weft, over two successive lower surface side wefts, under one lower surface side weft, over three successive lower surface side wefts, and under one lower surface side weft. A lower surface side weft has a design in which it passes over one lower surface side warp, under one lower surface side warp, over one lower surface side warp and under five successive lower surface side warps.

Such a design of a lower side layer is formed by disposing lower surface side wefts, each having a design in which it passes over one lower surface side warp, under one lower surface side warp, over one lower surface side warp and under five lower surface side warps, one after another while shifting the design. A complete design of the lower side layer is formed by disposing lower surface side wefts one after another while shifting the design by one warp, four warps, one warp and four warps successively. More specifically, the complete design is formed by disposing a first lower surface side weft, disposing a second lower surface side weft adjacent thereto while shifting the design by one warp, disposing a third lower surface side weft adjacent thereto while shifting the design by further four warps, disposing a fourth lower surface side weft adjacent thereto while shifting the design by further one warp, and then disposing a fifth lower surface side weft adjacent thereto while shifting the design by further four warps. The lower surface side warp obtained by shifting in such a manner has a 4/1-3/1-2/1-3/1 complete design.

The lower surface side warp having a 4/1-3/1-2/1-3/1 design is also available by shifting lower surface side wefts equal in design in another manner. The complete design of the lower side layer is formed by disposing lower surface side wefts one after another while shifting the design by three warps and four warps successively, more specifically, disposing a first lower surface side weft, disposing, adjacent thereto, a second lower surface side weft of the same design while shifting the design by three warps, disposing a third lower surface side weft adjacent thereto while shifting the design by further four warps, disposing a fourth lower surface side weft adjacent thereto while shifting the design by further three warps, and then disposing a fifth lower surface side weft adjacent thereto while shifting the design there by further four warps. The lower surface side warp thus formed by the repetition of such shifting has a 4/1-3/1-2/1-3/1 complete design.

The 4/1-3/1-2/1-3/1 design of the lower surface side warp is available by shifting lower surface side wefts equal in design in a further manner. The complete design of the lower side layer is formed by shifting the design by one warp, four warps, five warps and four warps successively, more specifically, disposing a first lower surface side weft, disposing a second lower surface side weft of the same design adjacent thereto while shifting the design by one warp, disposing a third lower surface side weft adjacent thereto while shifting the design by further four warps, disposing a fourth lower surface side weft adjacent thereto while shifting the design by further five warps, and disposing a fifth lower surface side weft adjacent thereto while shifting the design by further four warps. The lower surface side warp thus formed by repetition of such shifting has a 4/1-3/1-2/1-3/1 complete design.

The fabric with this design is particularly excellent in rigidity and wear resistance and is free from partial wear which will otherwise occur prior to whole wear. Such advantages will next be described referring to Conventional Example (FIGS. 23, 24A and 24B) given for describing the background art. A lower surface side weft in FIGS. 23, 24A and 24B has a design in which it passes over one lower surface side warp, under one lower surface side warp, over one lower surface side warp and then under five successive lower surface side warps. The complete design of the lower side layer is formed by disposing two lower surface side wefts adjacent to each other while shifting the design by five warps. The warp design thus formed is a design in which it passes under one lower surface side weft, over one lower surface side weft, under one lower surface side weft and then over five successive lower surface side wefts. A lower surface side weft between two lower surface side wefts under which lower surface side warps pass, respectively is pushed on the reverse side. As a result, only this portion wears away in advance and sometimes cannot be used because it is broken. Although there exists a portion of a lower surface side weft which passes over one lower surface side warp, under one lower surface side warp and then passes over one lower surface side warp, wefts are usually bendable easily from the viewpoints of the material quality or tension so that lower surface side wefts form a crimp along the pattern of warps and do not protrude from the surface of the fabric. At a portion where a warp passes over one lower surface side weft, under one lower surface side weft and over one lower surface side weft, the warp is relatively straight without bending so that the lower surface side weft is pushed and protrudes from the surface. This fact is known to those skilled in the art.

In the present invention, on the other hand, it is possible to prevent the protrusion of a lower surface side weft because owing to employment of 1-4, 3-4, 1-4-5-4 or the like shifting of lower surface side wefts, the warp design does not have such a portion at which a warp passes under one lower surface side weft, over one lower surface side weft and under one lower surface side weft. In this design in which one lower surface side weft passes over one lower surface side warp, under one lower surface side warp and over one lower surface side warp, the lower surface side weft is woven strongly so that the fabric has improved rigidity and undesirable movement of the lower surface side weft can be prevented. Moreover, since the lower surface side weft is woven strongly and therefore protrudes, a wear-resistant area increases, leading to improvement in wear resistance.

As design of the upper side layer, any design may be employed, for example, plain weave design, twill weave design or sateen weave design. Since the fabric of the present invention uses a warp binding yarn or weft binding yarn for weaving an upper side layer and one lower side layer while forming a portion of the upper side layer or lower side layer, it is recommended to make the upper side surface design formed by pairs of an upper surface side warp and a binding warp equal to that formed by an upper surface side warp or make the upper side surface design formed by pairs of an upper surface side weft and a weft binding yarn equal to that formed by an upper surface side weft. Then, a uniform surface can be formed.

Upper surface side wefts and lower surface side wefts are arranged preferably at from 1:1 to 2:1. The arrangement ratio is, for example, 1:1, 2:1, 3:2 or 4:3. It is not limited thereto and they may be arranged at another ratio. From the standpoints of surface property and fiber supporting property, the upper side layer has preferably an increased density, while from the standpoint of dehydration property and the like, the lower side layer has preferably a lower density. A lower surface side weft may or may not be disposed under a weft binding yarn.

Although no particular limitation is imposed on the diameter of constituent yarns, upper surface side wefts and upper surface side warps constituting the upper side surface preferably have a relatively smaller diameter in order to obtain a dense and smooth surface. For applications requiring a good surface property, use of warp binding yarns and upper surface side warps equal in diameter or use of weft binding yarns and upper surface side wefts equal in diameter is preferred. A difference in diameter between upper surface side warps and warp binding yarns is not preferred because yarns having a larger diameter may protrude from the upper side surface and give wire marks to paper. When upper surface side warps and warp binding yarns have the same diameter, warp knuckles on the upper side may have the same height, making it possible to form a relatively uniform surface. This equally applies to weft binding yarns.

Warp binding yarns and lower surface side warps may be adjusted to the same diameter if importance is attached to rigidity and wear resistance.

The lower side surface which will be brought into contact with a machine or roll requires rigidity and wear resistance so that lower surface side wefts and lower surface side warps have preferably a relatively large diameter. The diameter may be determined in consideration of the using purpose, using environment, arrangement ratio of upper and lower wefts and the like.

Yarns to be used in the present invention may be selected depending on the using purpose. Examples of them include, in addition to monofilaments, multifilaments, spun yarns, finished yarns subjected to crimping or bulking such as socalled textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool and metal. Of course, yarns obtained using copolymers or incorporating or mixing the above-described material with a substance according to the using purpose may be used.

As upper surface side warps, lower surface side warps, warp binding yarns and upper surface side wefts of a papermaking wire, polyester monofilaments having rigidity and excellent in dimensional stability are usually preferred. As lower surface side wefts requiring wear resistance, yarns obtained by combined weaving of a polyester monofilament and a polyamide monofilament, for example, alternately are preferred because such yarns have improved wear resistance without impairing rigidity. As weft binding yarns, polyamide monofilaments having resistance to squeezing are preferred.

EXAMPLES

The present invention will hereinafter be described specifically based on accompanying drawings.

Figure 22A:
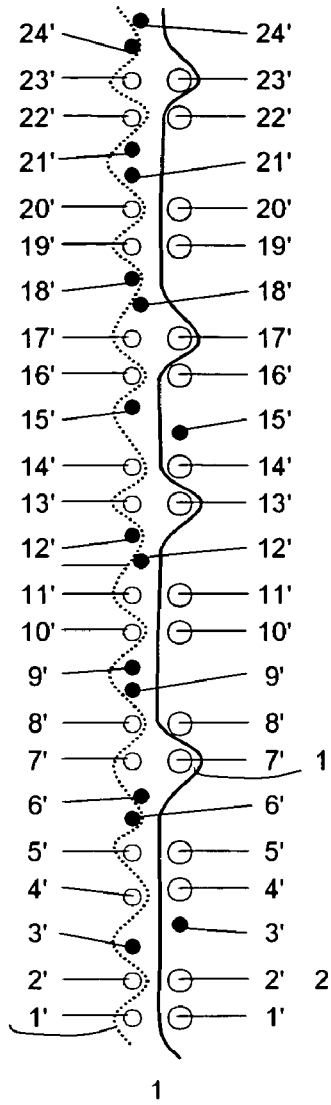
FIGS. 22A and 22B includes cross-sectional views taken along the lines 22A-22A and 22B-22B of the warp pair 1 and warp pair 2 illustrated in FIG. 21 respectively.
Figure 22B:
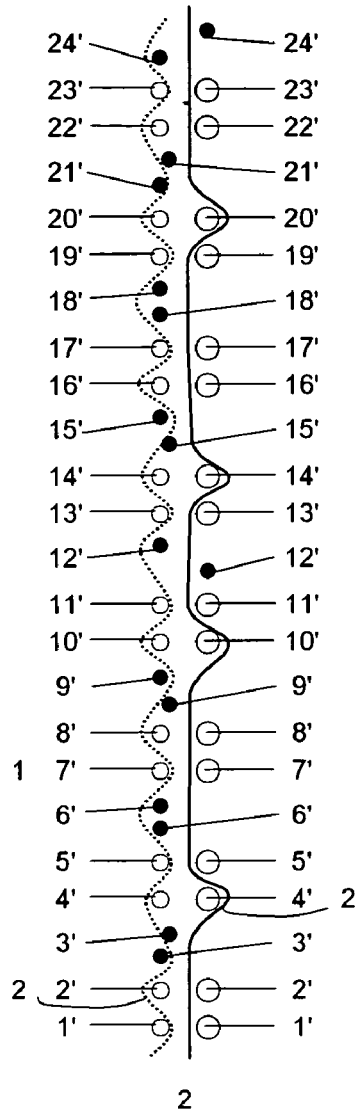
Figure 23:
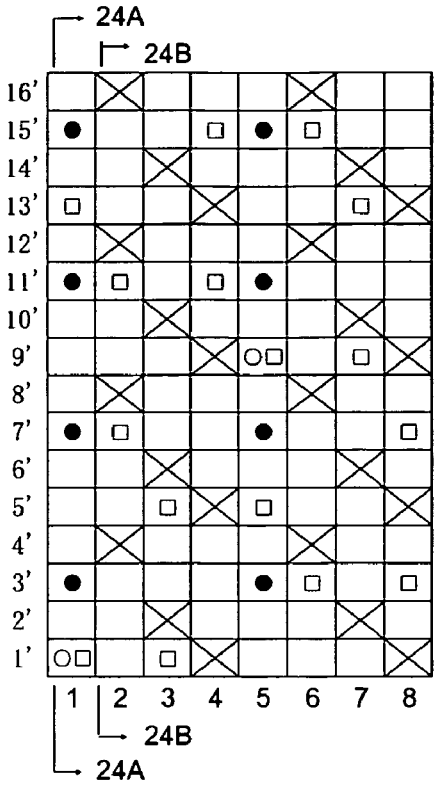
FIG. 23 is a design diagram of an industrial two-layer fabric according to Conventional Example 1.

FIGS. 1 to 22B illustrate an example of the present invention and they are design diagrams and cross-sectional views taken along warps. FIG. 23 is a design diagram of Conventional Example for comparing with that of the present invention and FIGS. 24A and 24B includes cross-sectional views taken along the lines 24A-24A and 24B-24B of the warps of FIG. 23 respectively.

A design diagram is a minimum repeating unit of a fabric design and it corresponds to a complete design of the fabric. This complete design is described in detail in claims of the present invention. A fabric is obtained by connecting this design in four directions. In the design diagram, warps are indicated by Arabic numerals, for example 1, 2 and 3, which include warp pairs composed of an upper surface side warp and a lower surface side warp, binding warp pairs composed of two warp binding yarns, binding warp pairs composed of an upper surface side warp and a warp binding yarn, and binding warp pairs composed of a lower surface side warp and a warp binding yarn. Wefts are indicated by Arabic numerals with a prime, for example, 1', 2' and 3'. In the design diagrams, these numerals with a prime mean that an upper surface side weft and a lower surface side weft are disposed vertically or only an upper surface side weft is disposed. This depends on their arrangement ratio. A weft binding yarn forming a pair is also indicated by an Arabic numeral with a prime.

In these diagrams, a mark "X" means that an upper surface side warp lies over an upper surface side weft; a mark "□" indicates that a lower surface side warp lies under a lower surface side weft; a mark "●" indicates that a warp binding yarn lies over an upper surface side weft; a mark "○" indicates that the warp binding yarn lies under a lower surface side weft; a mark "◆" also indicates that a warp binding yarn lies over an upper surface side weft; a mark "◇" indicates that the warp binding yarn lies under a lower surface side weft; a mark ◎ indicates that a weft binding yarn lies over an upper surface side warp, and a mark "○" indicates that the weft binding yarn lies under a lower surface side warp. The warp pair, binding warp pair, upper surface side weft, and lower surface side weft are illustrated together in one row so that it seems in the design diagram that yarns are vertically overlapped precisely. They are however illustrated as such for convenience of drawing and misalignment is allowed in the actual fabric. Two warps constituting the binding warp pair are attached to each other and function as one warp constituting an upper side complete design on the upper side surface, while it functions as one warp constituting a lower side complete design on the lower side surface. With regards to weft binding yarns forming a pair, two binding wefts are indicated in respective lines so that they do not seem to form one upper surface side weft, but actually, they get together and function as one upper surface side weft.

Example 1

Figure 2A:
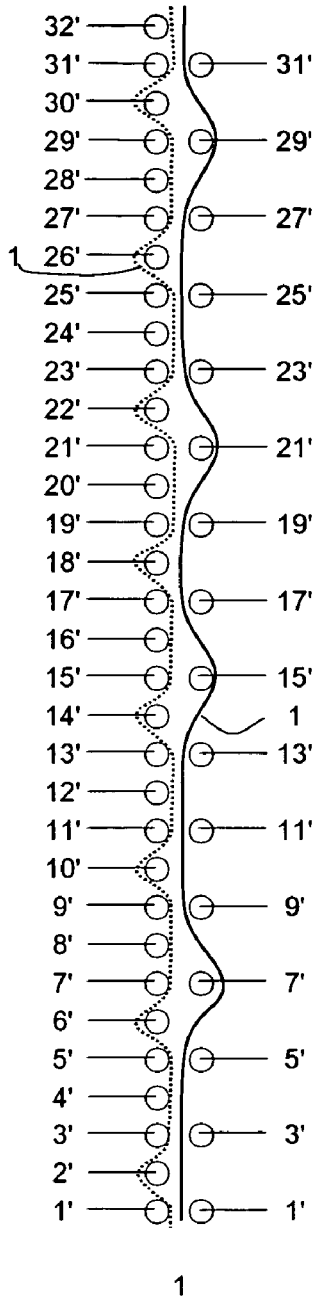
FIGS. 2A and 2B include cross-sectional views taken along the lines 2A-2A and 2B-2B of the warp pair 1 and binding warp pair 2 illustrated in FIG. 1 respectively.
Figure 2B:
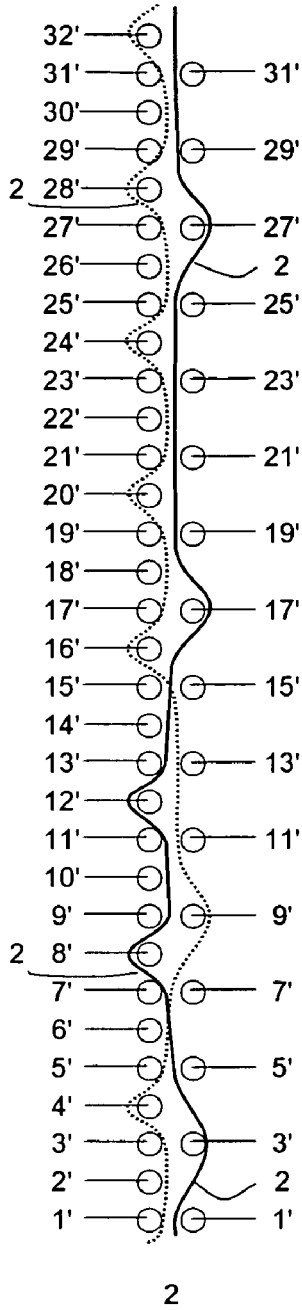

FIG. 1 is a design diagram of a fabric of Example 1 of the present invention. FIGS. 2A and 2B include cross-sectional views taken along the lines 2A-2A and 2B-2B of the warp pair 1 and binding warp pair 2 illustrated in the design diagram of FIG. 1 respectively. This fabric is woven by the pair of two warp binding yarns and it has a complete design formed by four binding warp pairs 2, 4, 6 and 8 and four warp pairs 1, 3, 5 and 7.

The fabric has, as an upper side layer, a sateen weave design obtained by shifting, with a certain regularity, a 1/3 design in which a warp passes over one upper surface side weft and then passes under three upper surface side wefts. Upper surface side wefts and lower surface side wefts are arranged at a ratio of 2:1.

In the design diagram of FIG. 1, indicated by numerals 2, 4, 6 and 8 are each a binding warp pair composed of two warp binding yarns, while indicated by numerals 1, 3, 5 and 7 are warp pairs composed of an upper surface side warp and a lower surface side warp.

A lower surface side weft constituting a lower side surface has a design in which it passes over one lower surface side warp, passes under one lower surface side warp, passes over one lower surface side warp and then passes under five successive lower surface side warps. For example, the lower surface side weft 1' passes over the lower surface side warp 6 shown in FIG. 1, passes under the lower surface side warp 7, passes over the lower surface side warp 8 and then passes under the five successive lower surface side warps 1 through 5. A complete design of the lower side layer is formed by shifting the design by one warp and four warps, successively, more specifically, disposing a first lower surface side weft, disposing a second lower surface side weft adjacent thereto while shifting the design by one warp (e.g., the relationship of the lower surface side wefts 3' and 5'), disposing a third lower surface side weft adjacent thereto while shifting the design by further four warps and repeating this shifting (e.g., the relationship of the lower surface side wefts 1' and 3').

A lower surface side warp has a 4/1-3/1-2/1-3/1 design in which it passes over four successive lower surface side wefts, passes under one lower surface side weft, passes over three successive lower surface side wefts, passes under one lower surface side weft, passes over two successive lower surface side wefts, passes under one lower surface side weft, passes over three successive lower surface side wefts and passes under one lower surface side weft. In the binding warp pair, two warp binding yarns form a 4/1-3/1-2/1-3/1 design while alternately passing under lower surface side wefts.

The lower surface side wefts of the present invention each has a portion shown as two of "○," "□" or "◇" lower surface side warp or warp binding yarn, passes under one lower surface side warp or warp binding yarn and then passes over one lower surface side warp or warp binding yarn. The lower surface side wefts are woven with lower surface side warps firmly so that the resulting fabric has rigidity. Adjacent to the portion, a crimp having an adequate length and passing under five successive lower surface side warps is formed so that no undesirable movement of wefts occur. In this design, the long crimp protrudes on the further lower surface side so that a wear-resistant volume increases, which leads to improvement of wear resistance.

Figure 24A:
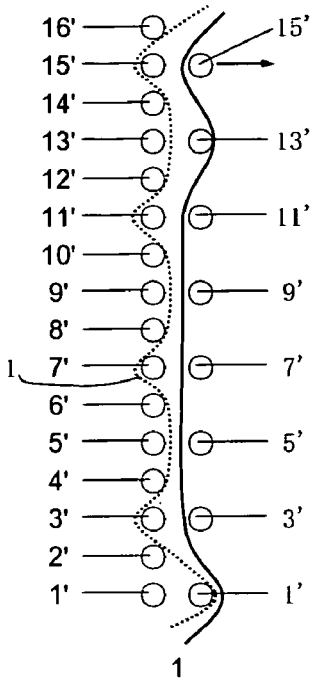
PRIOR ART FIG. 24A
FIGS. 24A and 24B include cross-sectional views taken along the lines 24A-24A and 24B-24B of the binding warp pair 1 and warp pair 2 illustrated in FIG. 23 respectively.
Figure 24B:
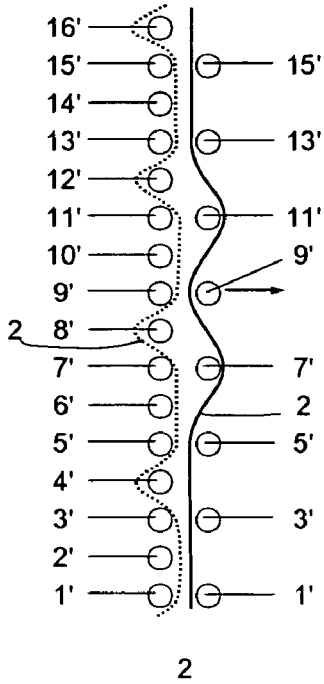
PRIOR ART FIG. 24B

The great difference from Conventional Example 1 illustrated in FIGS. 23, 24A and 24B is that owing to the design of lower surface side wefts free of protrusion on the reverse side, a partially uneven wear does not occur.

This advantage will next be described in comparison with Conventional Example 1. A lower surface side weft constituting the lower surface side layer in Conventional Example 1 has a design in which it passes over a lower surface side warp, under a lower surface side warp, over a lower surface side warp and then over five successive lower surface side warps. The complete design of the lower side layer is formed by disposing lower surface side wefts one after another while shifting the design by five warps successively. A lower side warp has accordingly a design in which it passes under a lower surface side weft, over a lower surface side weft, under a lower surface side weft and then over five successive lower surface side wefts. As can be understood from the cross-sectional view of warps in FIG. 24B, at a portion where lower surface side warp 2 passes under lower surface side weft 7', lower surface side warp 2 is woven with lower surface side weft 7' and pushed in a direction of the lower side. At a portion where lower surface side warp 2 passes under lower surface side weft 11', lower surface side warp 2 is woven with lower surface side weft 11' and pushed in a direction of the lower side. Lower surface side weft 9' present therebetween is woven with lower surface side warp 2 and weaves lower surface side warp 2 in the upper surface, but lower surface side weft 7' and lower surface side weft 11' on both sides thereof push lower surface side warp 2 to the lower surface side. As a result, lower surface side weft 9' inevitably protrudes on the lower surface side as shown by an arrow. Likewise, lower surface side weft 15' shown in FIG. 24A are pushed by the lower surface side wefts 13' and 1', and inevitably protrudes on the lower surface side as shown by an arrow.

A lower surface side weft present between the portions under which a lower surface side warp passes under a lower surface side weft is pushed to the reverse side. As a result, this portion of the lower surface side weft is worn away in advance and owing to breakage by the wear, it becomes unusable.

On the other hand, as shown in FIG. 2A, lower surface side warp 1 in this Example has a 4/1-3/1-2/1-3/1 design in which it passes over four successive lower surface side wefts 31', 1', 3' and 5', passes under a lower surface side weft 7', passes over three successive lower surface side wefts 9', 11' and 13', passes under a lower surface side weft 15', passes over two successive lower surface side wefts 17' and 19', passes under a lower surface side weft 21', passes over three successive lower surface side wefts 23', 25' and 27' and passes under a lower surface side weft 29'. A portion of lower surface side warp 1 passing under a lower surface side weft, over a lower surface side weft and under a lower surface side weft does not exist so that the lower surface side weft does not protrude to the reverse side.

In the binding warp pair, two warp binding yarns form a 4/1-3/1-2/1-3/1 design while alternately passing under lower surface side wefts. As shown in FIG. 2B, the binding warp 2 passes over four successive lower surface side wefts 19', 21', 23', and 25', passes under one lower surface side weft 27', passes over three successive lower surface side wefts 29', 31' and 1', passes under one lower surface side weft 3', passes over two successive lower surface side wefts 5' and 7', passes under one lower surface side weft 9', passes over three successive lower surface side wefts 11', 13' and 15' and passes under one lower surface side weft 17'.

In each of Example 1 and Conventional Example 1, description was made of only one lower surface side warp, but another lower surface side warp has a similar tendency.

The upper side layer has a design in which an upper surface side weft passes under a upper surface side warp and then passes over three upper surface side warps. Compared with the surface of a plain weave design, the shooting number of wefts can be made greater. The resulting fabric therefore has excellent surface property and fiber supporting property. In addition, owing to a diagonal space formed by weaving of the upper and lower layers by a warp binding yarn, the resulting fabric has excellent water drainage property and binding strength. The fabric according to Example 1 has excellent rigidity, wear resistance, surface property, fiber supporting property, water drainage property and binding strength and is free of undesirable movements of weft so that it is an excellent fabric.

Example 2

Figure 3:
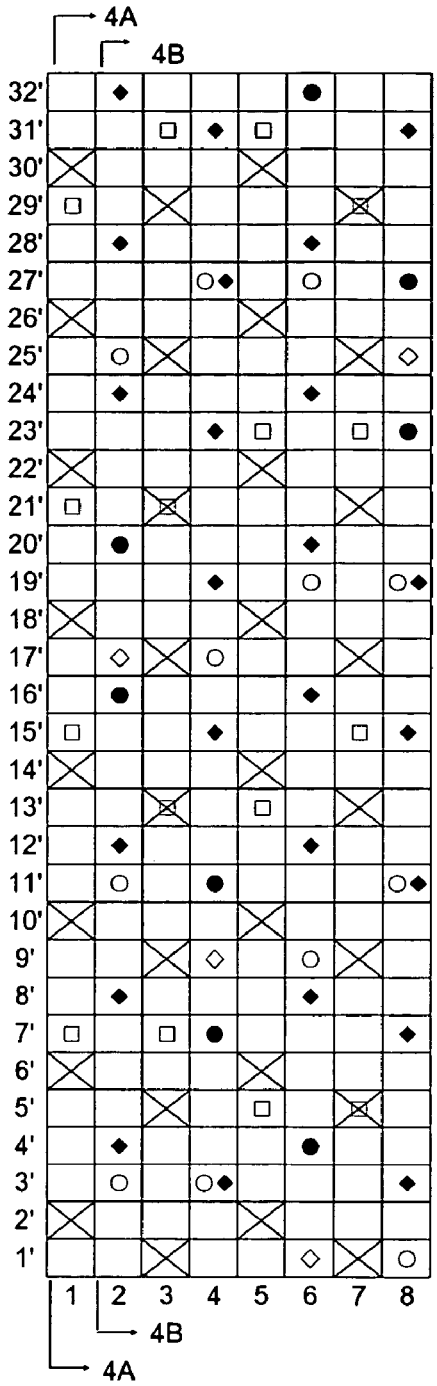
FIG. 3 is a design diagram of an industrial two-layer fabric according to Example 2 of the present invention.
Figure 4A:
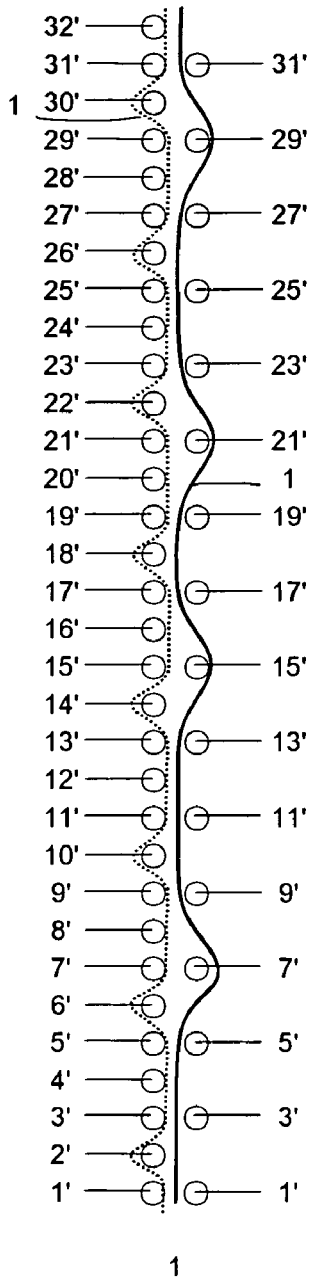
FIGS. 4A and 4B include cross-sectional views taken along the lines 4A-4A and 4B-4B of the warp pair 1 and binding warp pair 2 illustrated in FIG. 3 respectively.
Figure 4B:
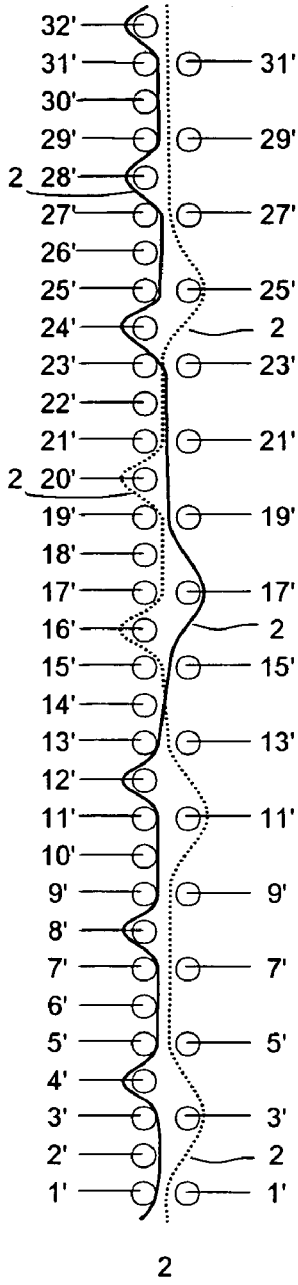

FIG. 3 is a design diagram illustrating a fabric of Example 2 according to the present invention. FIGS. 4A and 4B include cross-sectional views taken along the lines 4A-4A and 4B-4B of the warp pair 1 and the binding warp pair 2 illustrated in the design diagram of FIG. 3 respectively. The fabric of this example is woven by a pair of two warp binding yarns and four bind warp pairs and four warp pairs constitute its complete design.

The upper side layer of this fabric has a sateen weave design obtained by shifting, with certain regularity, a 1/3 design in which a warp passes over an upper surface side weft and passes under three upper surface side wefts. Upper surface side wefts and lower surface side wefts are arranged at a ratio of 2:1.

In the design diagram of FIG. 3, indicated by numerals 2, 4, 6 and 8 are binding warp pairs composed of two warp binding yarns, while indicated by numerals 1, 3, 5 and 7 are warp pairs composed of an upper surface side warp and a lower surface side warp. This fabric is different from the fabric of Example 1 in the shifting manner of lower surface side wefts adjacent to each other.

A lower surface side weft constituting the lower side surface has a design in which it passes over a lower surface side warp, under a lower surface side warp, over a lower surface side warp, and under five successive lower surface side warps. The complete design of the lower side layer is formed by disposing lower surface side wefts one after another while shifting the design by three warps and then by four warps successively, more specifically, disposing a first lower surface side weft, disposing a second lower surface side weft adjacent thereto while shifting the design by three warps, disposing a third lower surface side weft adjacent thereto while shifting the design by further four warps, and repeating this shifting successively.

A lower surface side warp has a 4/1-3/1-2/1-3/1 design similar to that of Example 1, while in a binding warp pair, two warp binding yarns also form a 4/1-3/1-2/1-3/1 design while alternately passing under lower surface side wefts.

A lower surface side weft of the present invention has a portion of passing over a lower surface side warp, under a lower surface side warp and then over a lower surface side warp. It weaves a lower surface side warp firmly so that the resulting fabric has rigidity. In addition, a crimp of an adequate length which passes under five successive lower surface side warps is formed adjacent to this portion so that wefts are woven firmly without causing undesirable movement. Moreover, the long crimp protrudes on a further lower side, which increases a wear-resistant volume and improves wear resistance. The lower surface side warp in this Example has a 4/1-3/1-2/1-3/1 design. Owing to the absence of a portion of passing under a lower surface side weft, over a lower surface side weft and under a lower surface side weft, a lower surface side weft does not protrude to the reverse side and a partially uneven wear of the lower surface side weft therefore does not occur.

The upper side layer has a design in which an upper surface side weft passes under a upper surface side warp and then passes over three upper surface side warps so that the shooting number of wefts can be made greater compared with a plain weave design. The resulting fabric has therefore excellent surface property and fiber supporting property. In addition, owing to a diagonal space formed by weaving of the upper and lower layers by a warp binding yarn, the resulting fabric has excellent water drainage property and binding strength.

As a result, the fabric according to this example has excellent rigidity, wear resistance, surface property, fiber supporting property, water drainage property and binding strength, and has less undesired movement of wefts.

Example 3

Figure 5:
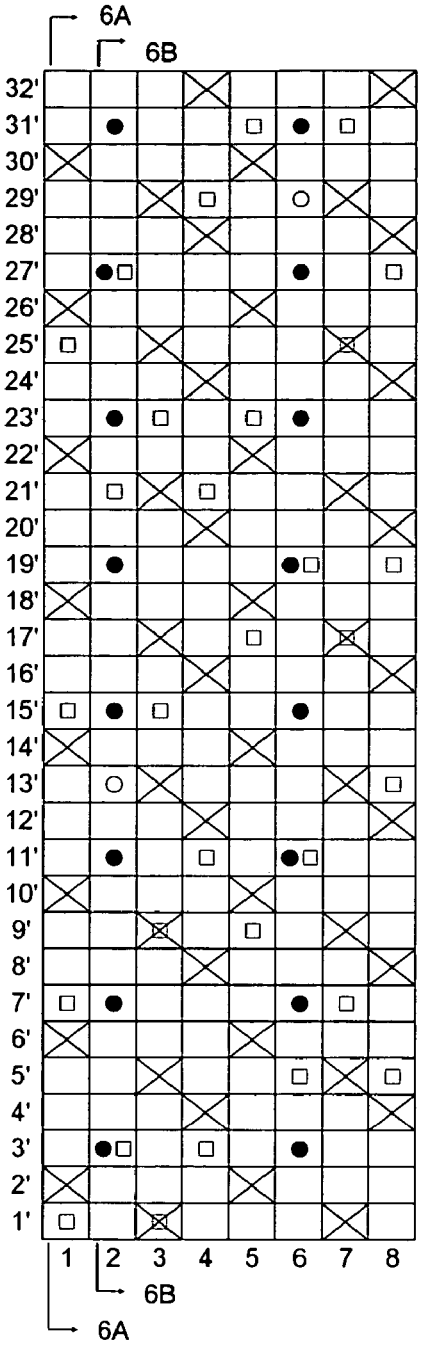
FIG. 5 is a design diagram of an industrial two-layer fabric according to Example 3 of the present invention.
Figure 6A:
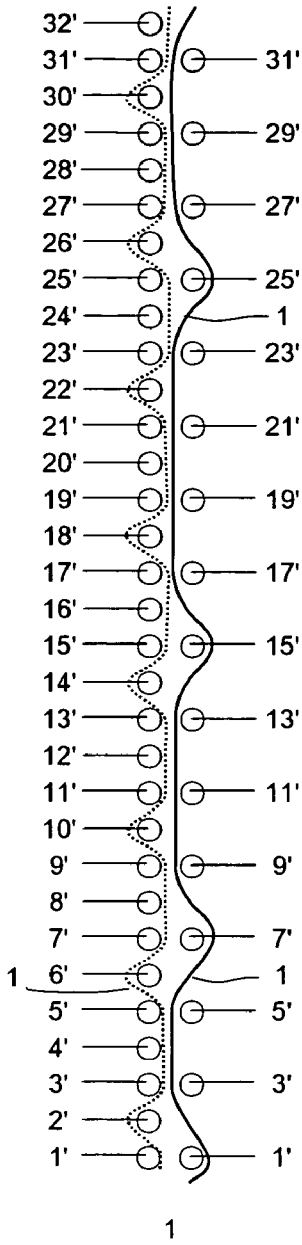
FIGS. 6A and 6B include cross-sectional views taken along the lines 6A-6A and 6B-6B of the warp pair 1 and binding warp pair 2 illustrated in FIG. 5 respectively.
Figure 6B:
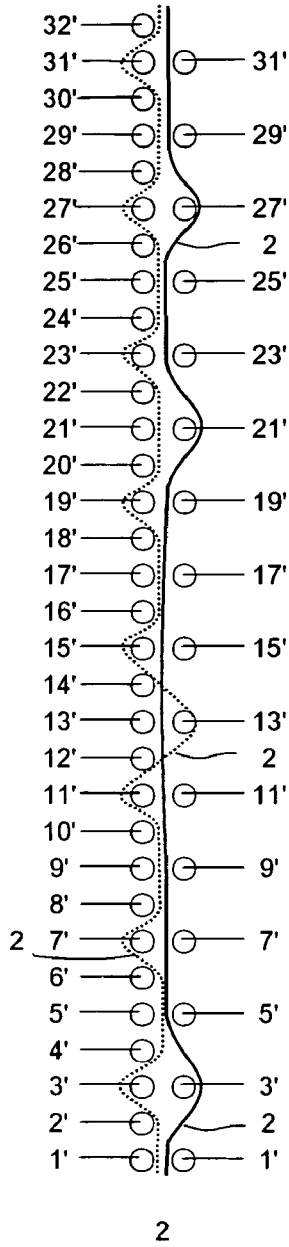

FIG. 5 is a design diagram illustrating a fabric of Example 3 according to the present invention. FIGS. 6A and 6B include cross-sectional views taken along the lines 6A-6A and 6B-6B of the warp pair 1 and the binding warp pair 2 illustrated in the design diagram of FIG. 5 respectively. The fabric of this example has a complete design formed by two binding warp pairs and six warp pairs. The binding warp pair is composed of a warp binding yarn and a lower surface side warp. The upper side layer of this fabric has a sateen weave design obtained by shifting, with certain regularity, a 1/3 design in which a warp passes over an upper surface side weft and then, passes under three upper surface side wefts. Upper surface side wefts and lower surface side wefts are arranged at a ratio of 2:1.

In the design diagram of FIG. 5, indicated by numerals 2 and 6 are binding warp pairs composed of a warp binding yarn and a lower surface side warp, while indicated by numerals 1, 3, 4, 5, 7 and 8 are warp pairs composed of an upper surface side warp and a lower surface side warp. This fabric is different from the fabric of Example 1 in the constitution of the binding warp pair.

A lower surface side weft constituting the lower side surface has a design in which it passes over a lower surface side warp, under a lower surface side warp, over a lower surface side warp, and under five successive lower surface side warps. The complete design of the lower side layer is formed by disposing lower surface side wefts one after another while shifting the design by one warp and then by four warps successively, more specifically, by disposing a first lower surface side weft, disposing a second lower surface side weft adjacent thereto while shifting the design by one warp, disposing a third lower surface side weft adjacent thereto while shifting the design by further four warps and repeating this shifting successively.

A lower surface side warp has a 4/1-3/1-2/1-3/1 design similar to that of Example 1, while in a binding warp pair, a warp binding yarn and a lower surface side warp form a 4/1-3/1-2/1-3/1 design on the lower surface side and a warp binding yarn, similar to an upper surface side warp, forms a 1/3 design on the upper surface side.

A lower surface side weft of the present invention has a portion of passing over a lower surface side warp, passing under a lower surface side warp and then passing over a lower surface side warp. It is therefore woven with a lower surface side warp firmly so that the resulting fabric has rigidity. In addition, a crimp of an adequate length which passes under five successive lower surface side warps is formed adjacent to this portion so that the fabric is free from undesirable movement of wefts. Moreover, the long crimp protrudes on a further lower surface side, which increases a wear-resistant volume and improves wear resistance. The lower surface side warp in this Example has a 4/1-3/1-2/1-3/1 design. Owing to absence of a portion of a lower surface side warp passing under a lower surface side weft, over a lower surface side weft and then under a lower surface side weft, a lower surface side weft does not protrude to the reverse side and occurrence of a partially uneven wear of a lower surface side weft is therefore prevented.

The upper side layer has a design in which an upper surface side weft passes under a upper surface side warp and then passes over three upper surface side warps so that the shooting number of wefts can be made greater compared with the surface of a plain weave design. The resulting fabric has therefore excellent surface property and fiber supporting property. In addition, owing to a diagonal space formed by weaving of the upper and lower layers by a warp binding yarn, the resulting fabric has excellent water drainage property and binding strength.

As a result, the fabric according to this example has excellent rigidity, wear resistance, surface property, fiber supporting property, water drainage property and binding strength, and is firmly woven without undesired movement of wefts.

Example 4

Figure 7:
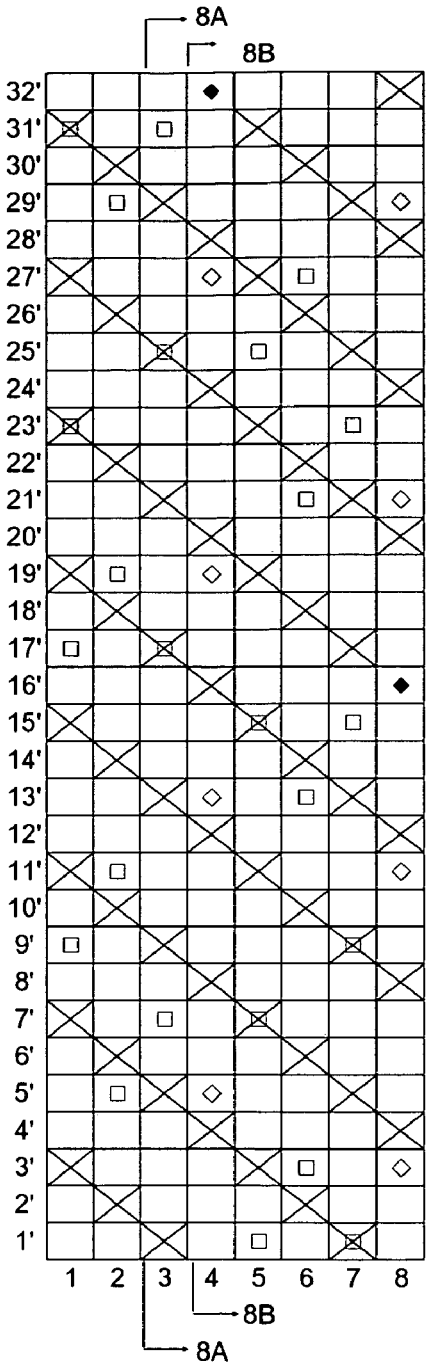
FIG. 7 is a design diagram of an industrial two-layer fabric according to Example 4 of the present invention.
Figure 8A:
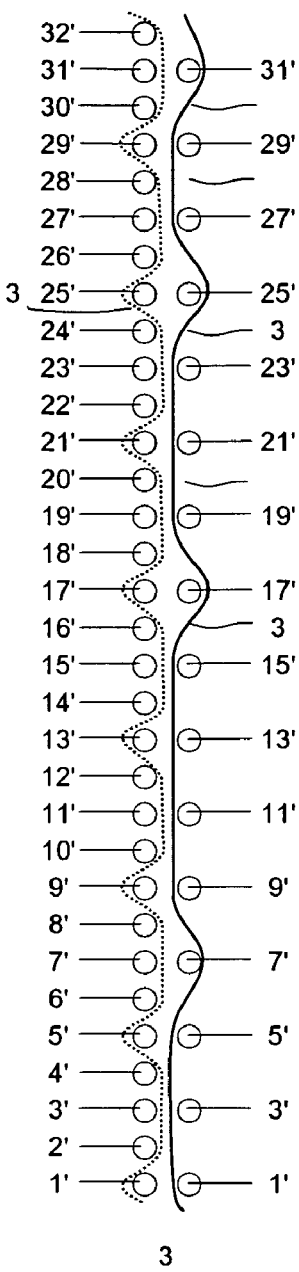
FIGS. 8A and 8B include cross-sectional views taken along the lines 8A-8A and 8B-8B of the warp pair 3 and binding warp pair 4 illustrated in FIG. 7 respectively.
Figure 8B:
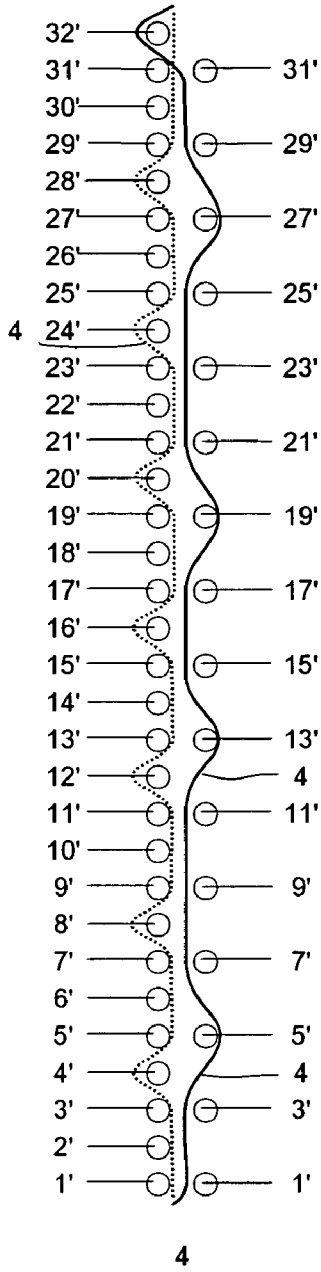

FIG. 7 is a design diagram illustrating a fabric of Example 4 according to the present invention. FIGS. 8A and 8B include cross-sectional views taken along the lines 8A-8A and 8B-8B of the warp pair 3 and the binding warp pair 4 illustrated in the design diagram of FIG. 7 respectively. The fabric of this example has a complete design formed by two binding warp yarns and six warp pairs. The binding warp pair is composed of a warp binding yarn and an upper surface side warp.

The upper side layer of this fabric has a twill weave design obtained by shifting, by one upper surface side weft, a 1/3 design in which a warp passes over an upper surface side weft and passes under three upper surface side wefts. Upper surface side wefts and lower surface side wefts are arranged at a ratio of 2:1.

In the design diagram of FIG. 7, indicated by numerals 4 and 8 are binding warp pairs composed of a warp binding yarn and an upper surface side warp, while indicated by numerals 1, 2, 3, 5, 6 and 7 are warp pairs composed of an upper surface side warp and a lower surface side warp. This fabric is different from the fabric of Example 3 in the constitution of the binding warp pair and upper side design.

A lower surface side weft constituting the lower side surface has a design in which it passes over a lower surface side warp, under a lower surface side warp, over a lower surface side warp, and under five successive lower surface side warps. The complete design of the lower side layer is formed by disposing lower surface side wefts one after another while shifting the design by one warp and four warps successively, more specifically, disposing a first lower surface side weft, disposing a second lower surface side weft adjacent thereto while shifting the design by one warp, disposing a third lower surface side weft adjacent thereto while shifting the design by further four warps, and repeating this shifting successively.

A lower surface side warp has a 4/1-3/1-2/1-3/1 design similar to Example 3. In a binding warp pair, a warp binding yarn also forms a 4/1-3/1-2/1-3/1 design on the lower surface side. On the upper surface side, an upper surface side warp does not pass over the upper surface side weft which the upper surface side warp must pass over, but instead, a warp binding yarn passes over the upper surface side weft and similar to another upper surface side warp, forms a 1/3 design on the upper side surface.

A lower surface side weft of the present invention has a portion of passing over a lower surface side warp, passing under a lower surface side warp and then passing over a lower surface side warp. It weaves a lower surface side warp firmly so that the resulting fabric has rigidity. In addition, a crimp of an adequate length which passes under five successive lower surface side warps is formed adjacent to this portion so that wefts are woven firmly without causing undesirable movement. Moreover, in this fabric, the long crimp protrudes on a further lower side, which increases a wear-resistant volume and improves wear resistance. The lower surface side warp in this Example has a 4/1-3/1-2/1-3/1 design. Owing to the absence of a portion of a lower surface side warp passing under a lower surface side weft, over a lower surface side weft and under a lower surface side weft, the lower surface side weft does not protrude to the reverse side and a partially uneven wear of the lower surface side weft therefore does not occur.

The upper side layer has a design in which an upper surface side weft passes under a upper surface side warp and then passes over three upper surface side warps so that the shooting number of wefts can be made greater compared with the surface of a plain weave design. The resulting fabric has therefore excellent surface property and fiber supporting property. In addition, owing to a diagonal space formed by weaving of the upper and lower layers by a warp binding yarn, the resulting fabric has excellent water drainage property and binding strength.

As a result, the fabric according to this example has excellent rigidity, wear resistance, surface property, fiber supporting property, water drainage property and binding strength, and is firmly woven without causing undesired movement of wefts.

Example 5

Figure 9:
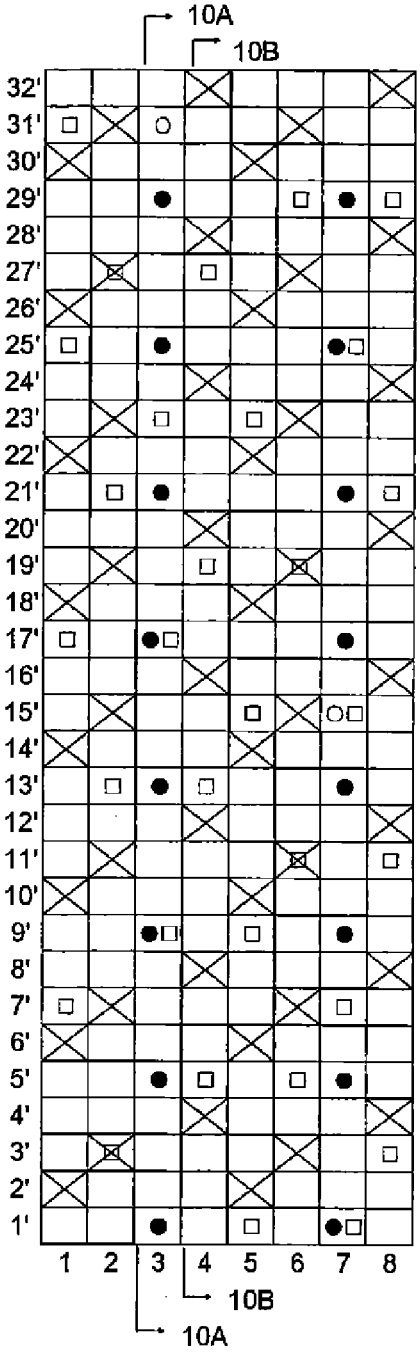
FIG. 9 is a design diagram of an industrial two-layer fabric according to Example 5 of the present invention.
Figure 10A:
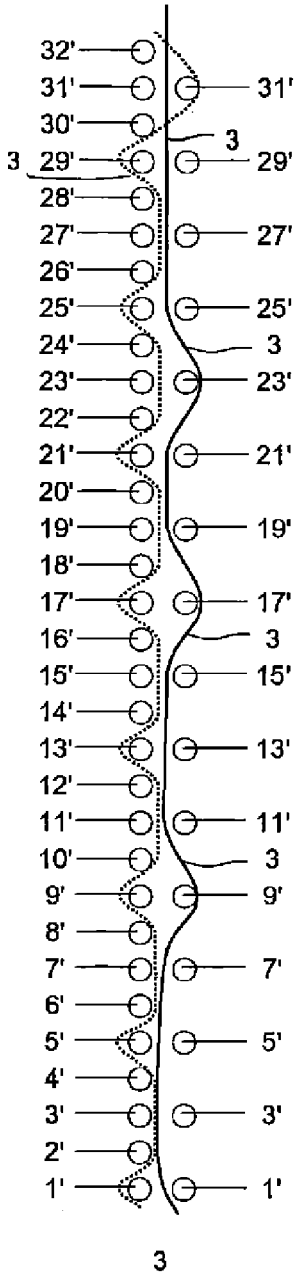
FIGS. 10A and 10B includes cross-sectional views taken along the lines 10A-10A and 10B-10B of the binding warp pair 3 and warp pair 4 illustrated in FIG. 9 respectively.
Figure 10B:
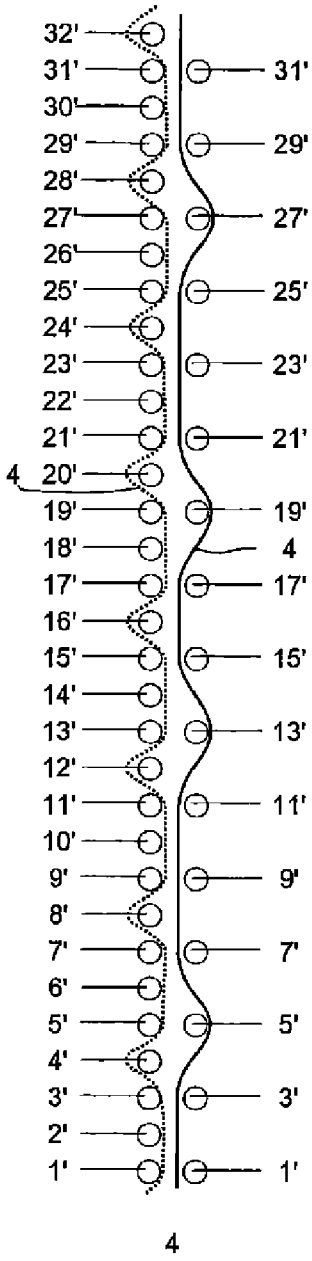

FIG. 9 is a design diagram illustrating a fabric of Example 5 according to the present invention. FIGS. 10A and 10B include cross-sectional views taken along the lines 10A-10A and 10B-10B of the binding warp pair 3 and the warp pair 4 illustrated in the design diagram of FIG. 9 respectively. The fabric of this example has a complete design formed by two binding warp pairs and six warp pairs. The binding warp pair is composed of a warp binding yarn and a lower surface side warp.

The upper side layer of this fabric has a sateen weave design obtained by shifting, with certain regularity, a 1/3 design in which a warp passes over an upper surface side weft and passes under three upper surface side wefts. Upper surface side wefts and lower surface side wefts are arranged at a ratio of 2:1.

In the design diagram of FIG. 9, indicated by numerals 3 and 7 are binding warp pairs composed of a warp binding yarn and a lower surface side warp, while indicated by numerals 1, 2, 4, 5, 6 and 8 are warp pairs composed of an upper surface side warp and a lower surface side warp.

A lower surface side weft constituting the lower side surface has a design in which it passes over a lower surface side warp, under a lower surface side warp, over a lower surface side warp, and under five successive lower surface side warps. The complete design of the lower side layer is formed by disposing lower surface side wefts one after another while shifting the design by three warps and four warps, successively, more specifically, disposing a first lower surface side weft, disposing a second lower surface side weft adjacent thereto while shifting the design by three warps, disposing a third lower surface side weft adjacent thereto, while shifting the design by further four warps, and repeating this shifting successively.

A lower surface side warp has a 4/1-3/1-2/1-3/1 design similar to Example 4, while in a binding warp pair, a warp binding yarn and a lower surface side form a 4/1-3/1-2/1-3/1 design on the lower surface side. On the upper surface side, a warp binding yarn, similar to an upper surface side warp, forms a 1/3 design on the upper side surface.

A lower surface side weft of the present invention has a portion of passing over a lower surface side warp, passing under a lower surface side warp and then passing over a lower surface side warp. It weaves a lower surface side warp firmly so that the resulting fabric has rigidity. In addition, a crimp of an adequate length which passes under five successive lower surface side warps is formed adjacent to this portion so that wefts are woven firmly without causing undesirable movement. Moreover, in this fabric, the long crimp protrudes on a further lower side, which increases a wear-resistant volume and improves wear resistance. The lower surface side warp in this Example has a 4/1-3/1-2/1-3/1 design. Owing to the absence of a portion of a lower surface side warp passing under a lower surface side weft, over a lower surface side weft and under a lower surface side weft, the lower surface side weft does not protrude to the reverse side and a partially uneven wear of the lower surface side weft therefore does not occur.

The upper side layer has a design in which an upper surface side weft passes under a upper surface side warp and then passes over three upper surface side warps so that the shooting number of wefts can be made greater compared with the surface of a plain weave design. The resulting fabric has therefore excellent surface property and fiber supporting property. In addition, owing to a diagonal space formed by weaving of the upper and lower layers by a warp binding yarn, the resulting fabric has excellent water drainage property and binding strength.

As a result, the fabric according to this example has excellent rigidity, wear resistance, surface property, fiber supporting property, water drainage property and binding strength, and is firmly woven without causing undesired movement of wefts.

Example 6

Figure 11:
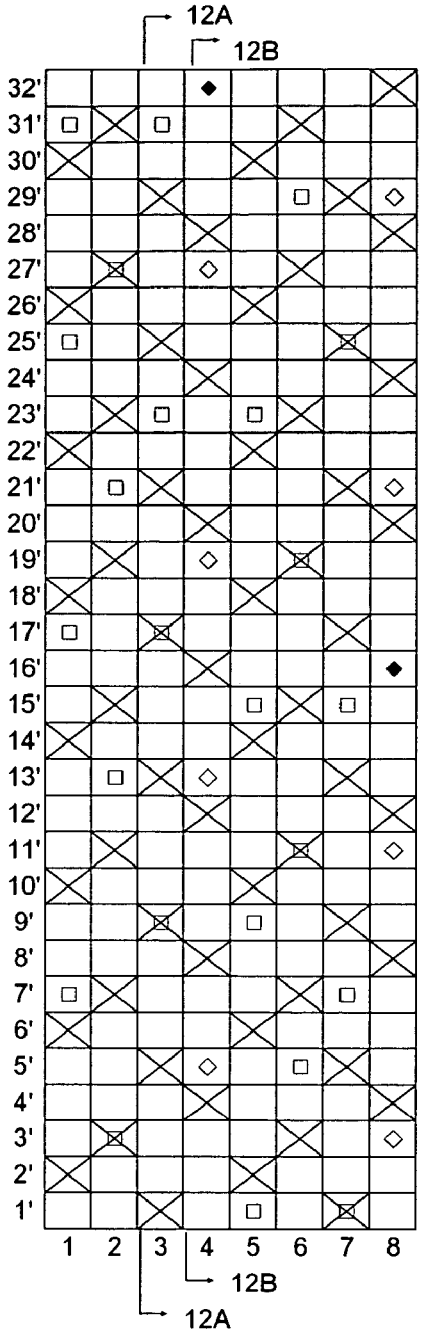
FIG. 11 is a design diagram of an industrial two-layer fabric according to Example 6 of the present invention.
Figure 12A:
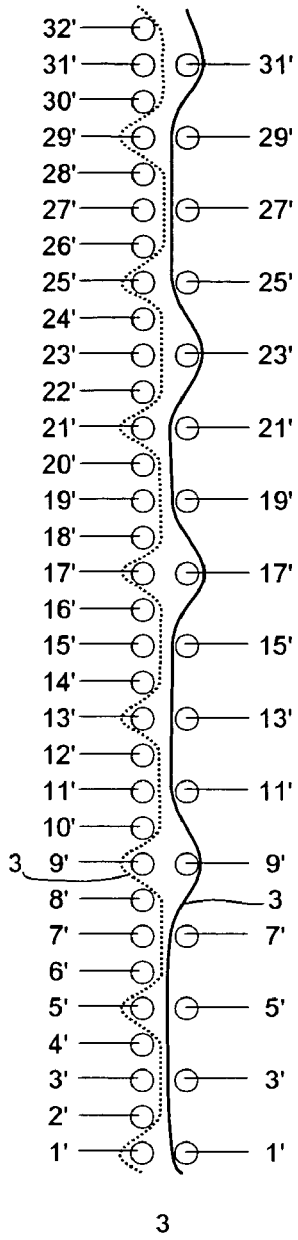
FIGS. 12A and 12B include cross-sectional views taken along the lines 12A-12A and 12B-12B of the warp pair 3 and binding warp pair 4 illustrated in FIG. 11 respectively.
Figure 12B:
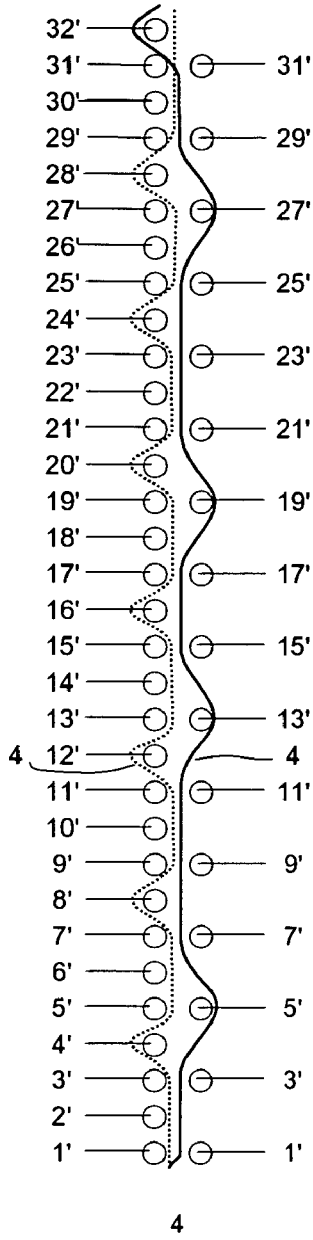

FIG. 11 is a design diagram illustrating a fabric of Example 6 according to the present invention. FIGS. 12A and 12B include cross-sectional views taken along the lines 12A-12A and 12B-12B of the warp pair 3 and the binding warp pair 4 illustrated in the design diagram of FIG. 11 respectively. The fabric of this example has a complete design formed by two binding warp pairs and six warp pairs. The binding warp pair is composed of a warp binding yarn and an upper surface side warp.

The upper side layer of this fabric has a sateen weave design obtained by shifting, with certain regularity, a 1/3 design in which a warp passes over an upper surface side weft and passes under three upper surface side wefts. Upper surface side wefts and lower surface side wefts are arranged at a ratio of 2:1.

In the design diagram of FIG. 11, indicated by numerals 4 and 8 are binding warp pairs composed of a warp binding yarn and an upper surface side warp, while indicated by numerals 1, 2, 3, 5, 6 and 7 are warp pairs composed of an upper surface side warp and a lower surface side warp.

A lower surface side weft constituting the lower side surface has a design in which it passes over a lower surface side warp, under a lower surface side warp, over a lower surface side warp, and under five successive lower surface side warps. The complete design of the lower side layer is formed by disposing lower surface side wefts one after another while shifting the design by three warps and four warps successively, more specifically, disposing a first lower surface side weft, disposing a second lower surface side weft adjacent thereto while shifting the design by three warps, disposing a third lower surface side weft adjacent thereto while shifting the design by further four warps, and repeating this shifting successively.

A lower surface side warp has a 4/1-3/1-2/1-3/1 design similar to that of Example 5, while in a binding warp pair, a warp binding yarn forms a 4/1-3/1-2/1-3/1 design on the lower surface side. On the upper surface side, an upper surface side warp does not pass over the upper surface side weft which the upper surface side warp must pass over, but instead, a warp binding yarn passes over the upper surface side weft and similar to another upper surface side warp, forms a 1/3 design on the upper side surface.

A lower surface side weft of the present invention has a portion of passing over a lower surface side warp, passing under a lower surface side warp and then passing over a lower surface side warp. It weaves a lower surface side warp firmly so that the resulting fabric has rigidity. In addition, a crimp of an adequate length which passes under five successive lower surface side warps is formed adjacent to this portion so that wefts are woven firmly without causing undesirable movement. Moreover, in this fabric, the long crimp protrudes on a further lower side, which increases a wear-resistant volume and improves wear resistance. The lower surface side warp in this Example has a 4/1-3/1-2/1-3/1 design. Owing to the absence of a portion of a lower surface side warp passing under a lower surface side weft, over a lower surface side weft and under a lower surface side weft, the lower surface side weft does not protrude to the reverse side and a partially uneven wear of the lower surface side weft therefore does not occur.

The upper side layer has a design in which an upper surface side weft passes under a upper surface side warp and then passes over three upper surface side warps so that the shooting number of wefts can be made greater compared with the surface of a plain weave design. The resulting fabric has therefore excellent surface property and fiber supporting property. In addition, owing to a diagonal space formed by weaving of the upper and lower layers by a warp binding yarn, the resulting fabric has excellent water drainage property and binding strength.

As a result, the fabric according to this example has excellent rigidity, wear resistance, surface property, fiber supporting property, water drainage property and binding strength, and is firmly woven without causing undesired movement of wefts.

Example 7

Figure 13:
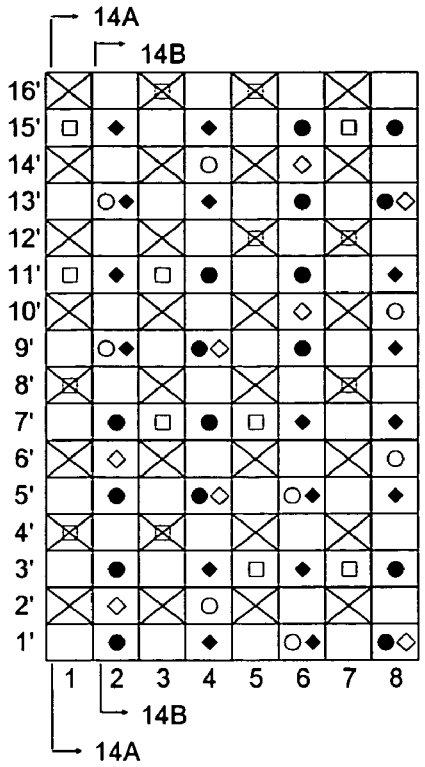
FIG. 13 is a design diagram of an industrial two-layer fabric according to Example 7 of the present invention.
Figure 14A:
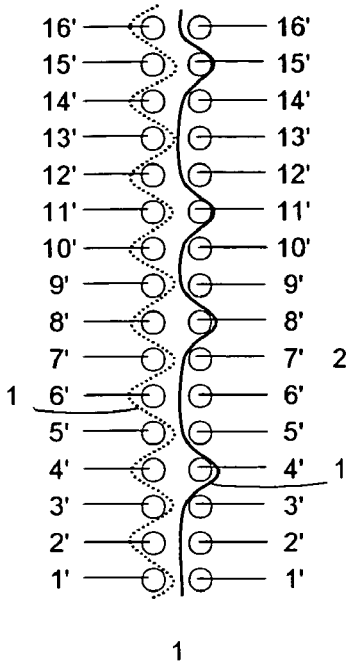
FIGS. 14A and 14B include cross-sectional views taken along the lines 14A-14A and 14B-14B of the warp pair 1 and binding warp pair 2 illustrated in FIG. 13 respectively.
Figure 14B:
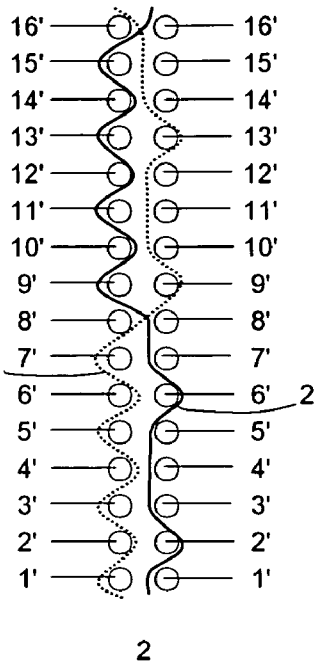

FIG. 13 is a design diagram illustrating a fabric of Example 7 according to the present invention. FIGS. 14A and 14B include cross-sectional views taken along the lines 14A-14A and 14B-14B of the warp pair 1 and the binding warp pair 2 illustrated in the design diagram of FIG. 13 respectively. This fabric is woven by two warp binding yarns constituting a pair and has a complete design formed by four binding warp pairs and four warp pairs.

The upper side layer of this fabric has a 1/1 plain weave design in which a warp passes over an upper surface side weft and passes under an upper surface side weft. Upper surface side wefts and lower surface side wefts are arranged at a ratio of 1:1.

In the design diagram of FIG. 13, indicated by numerals 2, 4, 6 and 8 are binding warp pairs composed of two warp binding yarns, while indicated by numerals 1, 3, 5 and 7 are warp pairs composed of an upper surface side warp and a lower surface side warp. This fabric is different from that of Example 6 in the design of the upper side layer and arrangement ratio of wefts.

A lower surface side weft constituting the lower side surface has a design in which it passes over a lower surface side warp, under a lower surface side warp, over a lower surface side warp, and under five successive lower surface side warps. The complete design of the lower side layer is formed by disposing lower surface side wefts one after another while shifting the design by three warps and four warps successively, more specifically, disposing a first lower surface side weft, disposing a second lower surface side weft adjacent thereto while shifting the design by three warps, disposing a third lower surface side weft adjacent thereto while shifting the design by further four warps and repeating this shifting successively.

A lower surface side warp has a 4/1-3/1-2/1-3/1 design similar to that of Example 1. Also in a binding warp pair, two warp binding yarns pass under lower surface side wefts alternately and form a 4/1-3/1-2/1-3/1 design.

A lower surface side weft of the present invention has a portion of passing over a lower surface side warp, passing under a lower surface side warp and then passing over a lower surface side warp. It weaves a lower surface side warp firmly so that the resulting fabric has rigidity. In addition, a crimp of an adequate length which passes under five successive lower surface side warps is formed adjacent to this portion so that wefts are woven firmly without causing undesirable movement. Moreover, in this fabric, the long crimp protrudes on a further lower side, which increases a wear-resistant volume and improves wear resistance. The lower surface side warp in this Example has a 4/1-3/1-2/1-3/1 design. Owing to the absence of a portion of a lower surface side warp passing under a lower surface side weft, over a lower surface side weft and under a lower surface side weft, the lower surface side weft does not protrude to the reverse side and a partially uneven wear of the lower surface side weft therefore does not occur.

The upper side layer has a plain weave design so that the resulting fabric has excellent surface property, fiber supporting property and rigidity. In addition, owing to a diagonal space formed by weaving of the upper and lower layers by a warp binding yarn, the resulting fabric has excellent water drainage property and binding strength.

As a result, the fabric according to this example has excellent rigidity, wear resistance, surface property, fiber supporting property, water drainage property and binding strength, and is firmly woven without undesired movement of wefts.

Example 8

Figure 15:
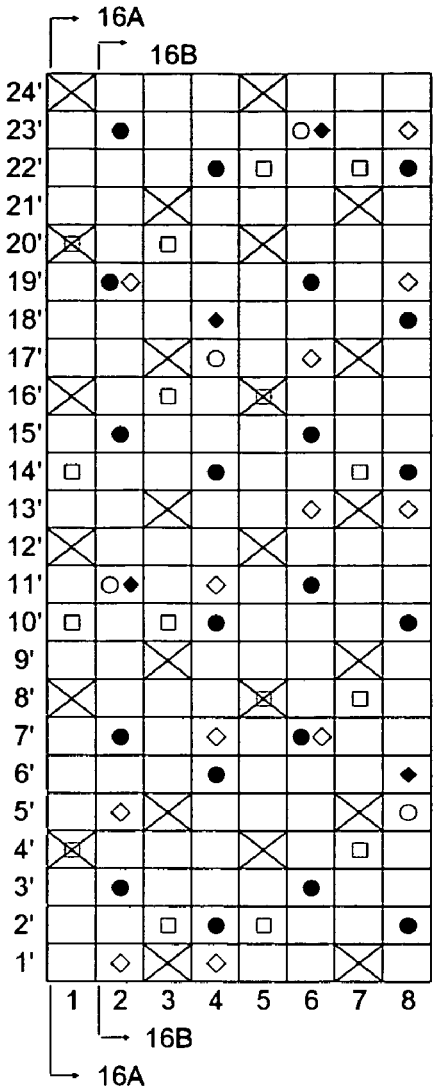
FIG. 15 is a design diagram of an industrial two-layer fabric according to Example 8 of the present invention.
Figure 16A:
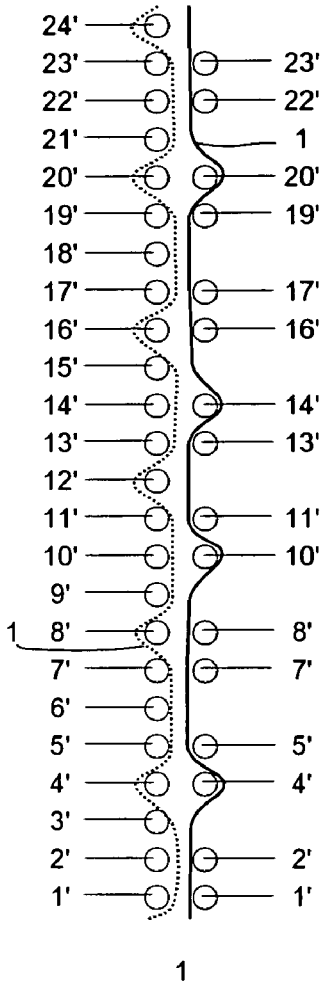
FIGS. 16A and 16B includes cross-sectional views taken along the lines 16A-16A and 16B-16B of the warp pair 1 and binding warp pair 2 illustrated in FIG. 15 respectively.
Figure 16B:
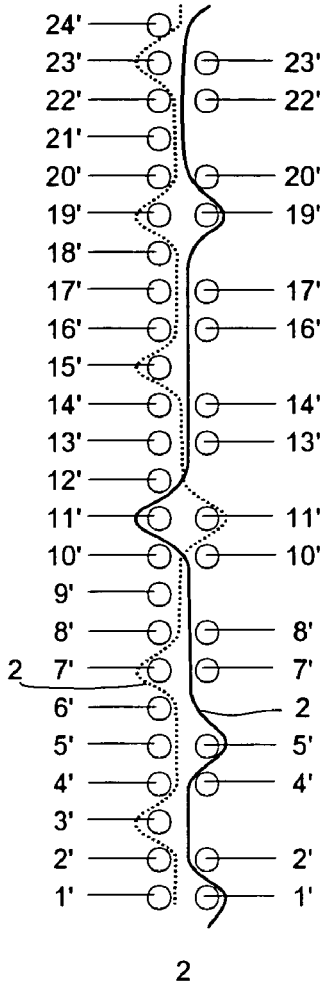

FIG. 15 is a design diagram illustrating a fabric of Example 8 according to the present invention. FIGS. 16A and 16B include cross-sectional views taken along the lines 16A-16A and 16B-16B of the warp pair 1 and the binding warp pair 2 illustrated in the design diagram of FIG. 15 respectively. The fabric is woven by two warp binding yarns constituting a pair and has a complete design formed by four binding warp pairs and four warp pairs.

The upper side layer of this fabric has a sateen weave design obtained by shifting, with certain regularity, a 1/3 design in which a warp passes over an upper surface side weft and passes under three upper surface side wefts. Upper surface side wefts and lower surface side wefts are arranged at a ratio of 3:2.

In the design diagram of FIG. 15, indicated by numerals 2, 4, 6 and 8 are binding warp pairs composed of two warp binding yarns, while indicated by numerals 1, 3, 5 and 7 are warp pairs composed of an upper surface side warp and a lower surface side warp.

A lower surface side weft constituting the lower side surface has a design in which it passes over a lower surface side warp, under a lower surface side warp, over a lower surface side warp, and under five successive lower surface side warps. The complete design of the lower side layer is formed by disposing lower surface side wefts one after another while shifting the design by one warp and four warps successively, more specifically, disposing a first lower surface side weft, disposing a second lower surface side weft adjacent thereto while shifting the design by one warp, disposing a third lower surface side weft adjacent thereto while shifting the design by further four warps, and repeating this shifting successively.

A lower surface side warp has a 4/1-3/1-2/1-3/1 design similar to that of Example 1. Also in a binding warp pair, two warp binding yarns alternately pass under lower surface side wefts and form a 4/1-3/1-2/1-3/1 design.

A lower surface side weft of the present invention has a portion of passing over a lower surface side warp, passing under a lower surface side warp and then passing over a lower surface side warp. It weaves a lower surface side warp firmly so that the resulting fabric has rigidity. In addition, a crimp of an adequate length which passes under five successive lower surface side warps is formed adjacent to this portion so that wefts are woven firmly without causing undesirable movement. Moreover, in this fabric, the long crimp protrudes on a further lower side, which increases a wear-resistant volume and improves wear resistance. The lower surface side warp in this Example has a 4/1-3/1-2/1-3/1 design. Owing to the absence of a portion of a lower surface side warp passing under a lower surface side weft, over a lower surface side weft and under a lower surface side weft, the lower surface side weft does not protrude to the reverse side and a partially uneven wear of the lower surface side weft therefore does not occur.

The upper side layer has a design in which an upper surface side weft passes under a upper surface side warp and then passes over three upper surface side warps so that the shooting number of wefts can be made greater compared with the surface of a plain weave design. The resulting fabric has therefore excellent surface property and fiber supporting property. In addition, owing to a diagonal space formed by weaving of the upper and lower layers by a warp binding yarn, the resulting fabric has excellent water drainage property and binding strength.

As a result, the fabric according to this example has excellent rigidity, wear resistance, surface property, fiber supporting property, water drainage property and binding strength, and is firmly woven without causing undesired movement of wefts.

Example 9

Figure 17:
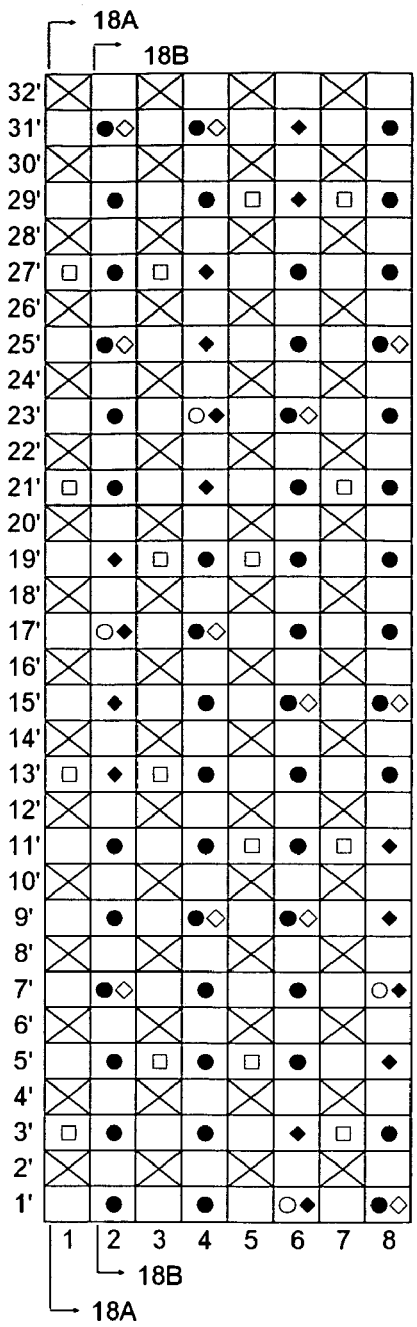
FIG. 17 is a design diagram of an industrial two-layer fabric according to Example 9 of the present invention.
Figure 18A:
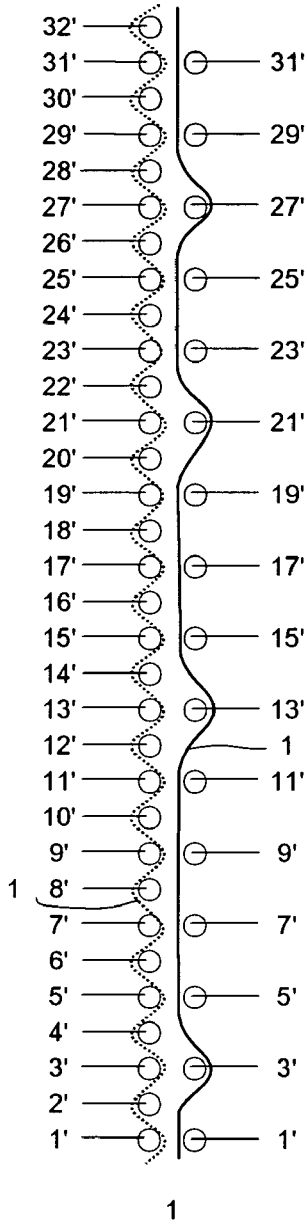
FIGS. 18A and 18B include cross-sectional views taken along the lines 18A-18A and 18B-18B of the warp pair 1 and warp pair 2 illustrated in FIG. 17.
Figure 18B:
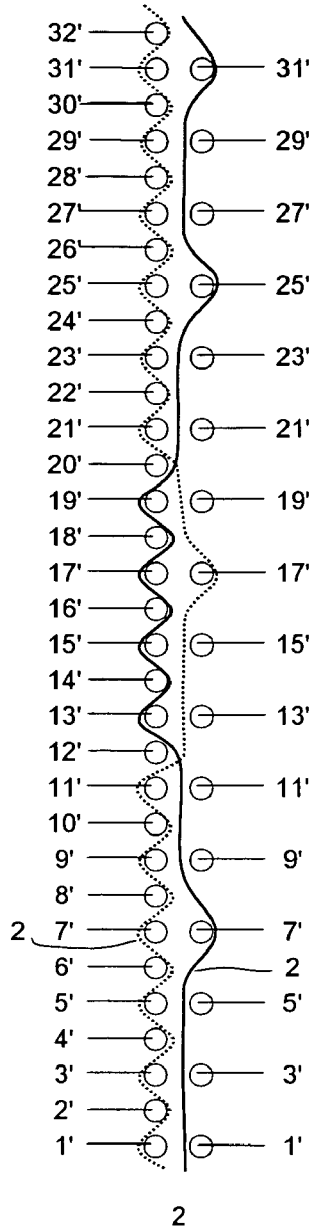

FIG. 17 is a design diagram illustrating a fabric of Example 9 according to the present invention. FIGS. 18A and 18B include cross-sectional views taken along the lines 18A-18A and 18B-18B of the warp pair 1 and the binding warp pair 2 illustrated in the design diagram of FIG. 17 respectively. This fabric is woven by two warp binding yarns constituting a pair and has a complete design formed by four binding warp pairs and four warp pairs.

The upper side layer of this fabric has a 1/1 plain weave design in which a warp passes over an upper surface side weft and then passes under an upper surface side weft. Upper surface side wefts and lower surface side wefts are arranged at a ratio of 2:1.

In the design diagram of FIG. 17, indicated by numerals 2, 4, 6 and 8 are binding warp pairs composed of two warp binding yarns, while indicated by numerals 1, 3, 5 and 7 are warp pairs composed of an upper surface side warp and a lower surface side warp.

A lower surface side weft constituting the lower side surface has a design in which it passes over a lower surface side warp, under a lower surface side warp, over a lower surface side warp, and under five successive lower surface side warps. The complete design of the lower side layer is formed by disposing lower surface side wefts one after another while shifting the design by one warp, four warps, five warps and four warps successively, more specifically, disposing a first lower surface side weft, disposing a second lower surface side weft adjacent thereto while shifting the design by one warp, disposing a third lower surface side weft adjacent thereto while shifting the design by further four warps, disposing a fourth lower surface side weft adjacent thereto while shifting the design by further five warps, disposing a fifth lower surface side weft adjacent thereto while shifting the design by further four warps.

A lower surface side warp has a 4/1-3/1-2/1-3/1 design similar to that of Example 1. Also in a binding warp pair, two warp binding yarns pass under lower surface side wefts alternately and forms a 4/1-3/1-2/1-3/1 design.

A lower surface side weft of the present invention has a portion of passing over a lower surface side warp, passing under a lower surface side warp and then passing over a lower surface side warp. It weaves a lower surface side warp firmly so that the resulting fabric has rigidity. In addition, a crimp of an adequate length which passes under five successive lower surface side warps is formed adjacent to this portion so that wefts are woven firmly without causing undesirable movement. Moreover, in this fabric, the long crimp protrudes on a further lower side, which increases a wear-resistant volume and improves wear resistance. The lower surface side warp in this Example has a 4/1-3/1-2/1-3/1 design. Owing to the absence of a portion of a lower surface side warp passing under a lower surface side weft, over a lower surface side weft and under a lower surface side weft, the lower surface side weft does not protrude to the reverse side and a partially uneven wear of the lower surface side weft therefore does not occur.

The upper side layer has a plain weave design so that the resulting fabric has excellent surface property, fiber supporting property and rigidity. In addition, owing to a diagonal space formed by weaving of the upper and lower layers by a warp binding yarn, the resulting fabric has excellent water drainage property and binding strength.

As a result, the fabric according to this example has excellent rigidity, wear resistance, surface property, fiber supporting property, water drainage property and binding strength, and is firmly woven without undesired movement of wefts.

Example 10

Figure 19:
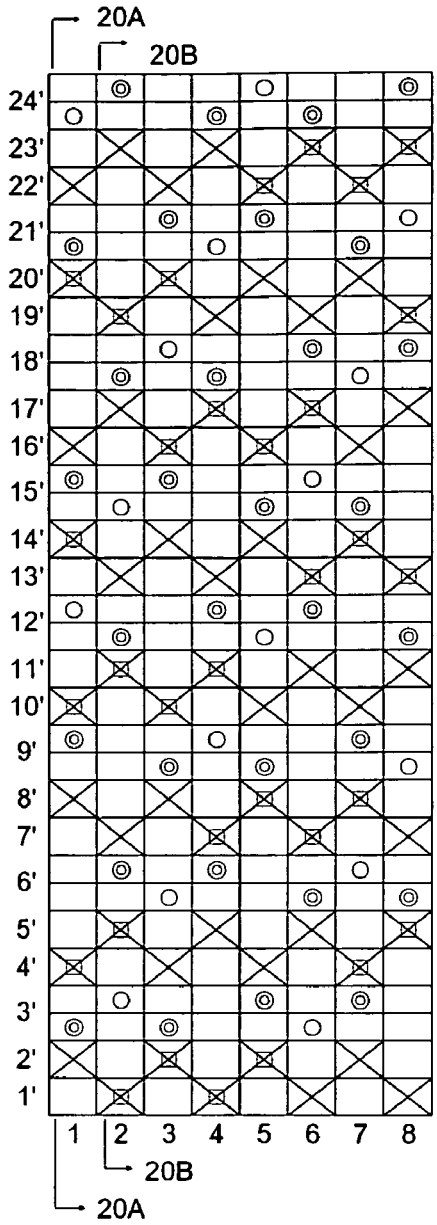
FIG. 19 is a design diagram of an industrial two-layer fabric according to Example 10 of the present invention.
Figure 20A:
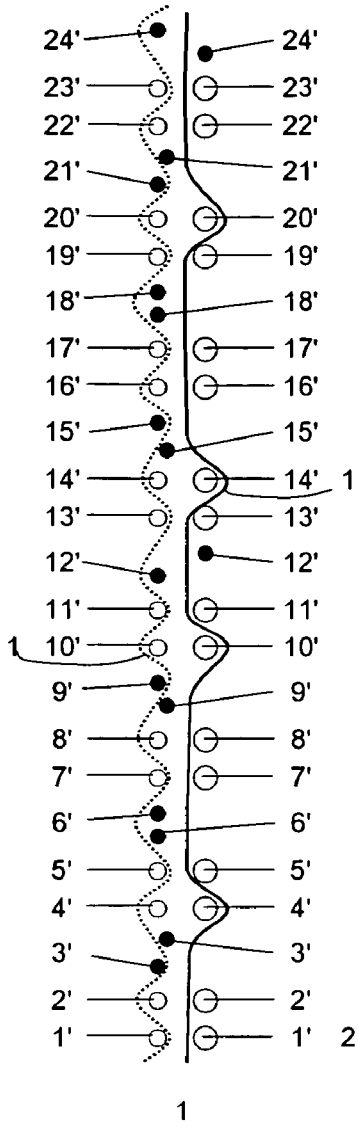
FIGS. 20A and 20B include cross-sectional views taken along the lines 20A-20A and 20B-20B of the warp pair 1 and warp pair 2 illustrated in FIG. 19 respectively.
Figure 20B:
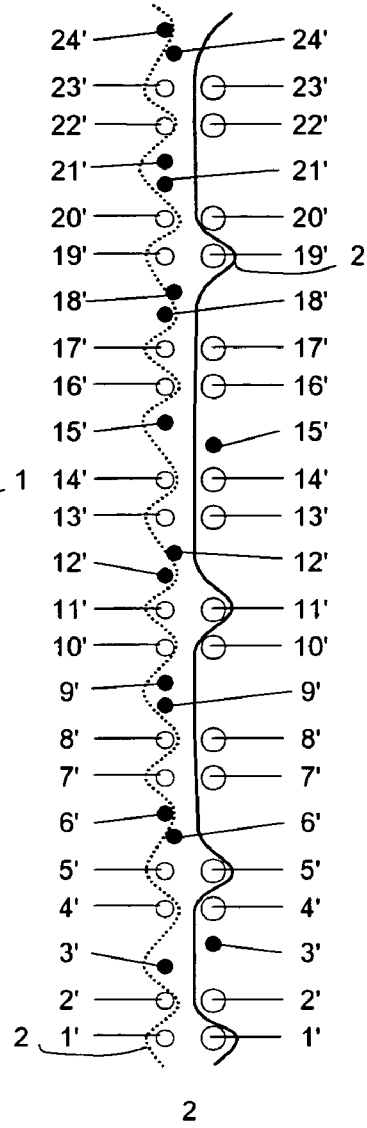

FIG. 19 is a design diagram illustrating a fabric of Example 10 according to the present invention. FIGS. 20A and 20B include cross-sectional views taken along the lines 20A-20A and 20B-20B of the warp pairs 1 and 2 illustrated in the design diagram of FIG. 19 respectively. The fabrics of the above-described examples are each obtained by weaving upper and lower layers by a warp binding yarn, while the fabric of this example is woven by two weft binding yarns constituting a pair.

The weft binding yarns form a pair and function as one weft on the upper side surface. The upper side layer has pairs of weft binding yarns and upper surface side wefts arranged alternately and has a 1/1 plain design in which a warp passes over an upper surface side weft or over a pair of weft binding yarns, and then passes under an upper surface side weft or a weft binding yarn. The weft binding yarn has no lower surface side weft disposed thereunder. In the design diagram of FIG. 19, indicated by numerals 3', 6', 9', 12', 15', 18', 21' and 24' are pairs of two weft binding yarns, while indicated by numerals 1', 2', 4', 5', 7', 8', 10', 11', 13', 14', 16', 17', 19', 20', 22' and 23' are an upper surface side weft and a lower surface side weft arranged vertically.

A lower surface side weft constituting the lower side surface has a design in which it passes over a lower surface side warp, under a lower surface side warp, over a lower surface side warp, and under five successive lower surface side warps. The complete design of the lower side layer is formed by disposing lower surface side wefts one after another while shifting the design by one warp and four warps successively, more specifically, disposing a first lower surface side weft, disposing a second lower surface side weft adjacent thereto while shifting the design by one warp, disposing a third lower surface side weft adjacent thereto while shifting the design by further four warps, and repeating this shifting successively.

A lower surface side warp has a 4/1-3/1-2/1-3/1 design in which it passes over four successive lower surface side wefts, passes under a lower surface side weft, passes over three successive lower surface side wefts, passes under a lower surface side weft, passes over two successive lower surface side wefts, passes under a lower surface side weft, passes over three successive lower surface side wefts and passes under a lower surface side weft.

A lower surface side weft of the present invention has a portion of passing over a lower surface side warp, passing under a lower surface side warp and then passing over a lower surface side warp. It weaves a lower surface side warp firmly so that the resulting fabric has rigidity. In addition, a crimp of an adequate length which passes under five successive lower surface side warps is formed adjacent to this portion so that wefts are woven firmly without causing undesirable movement. Moreover, in this fabric, the long crimp protrudes on a further lower side, which increases a wear-resistant volume and improves wear resistance. The lower surface side warp in this Example has a 4/1-3/1-2/1-3/1 design. Owing to the absence of a portion of a lower surface side warp passing under a lower surface side weft, over a lower surface side weft and under a lower surface side weft, the lower surface side weft does not protrude to the reverse side and a partially uneven wear of the lower surface side weft therefore does not occur.

The upper side layer has a plain weave design so that the resulting fabric has excellent surface property, fiber supporting property, and rigidity. In addition, since upper and lower layers are woven by a weft binding yarn, the resulting fabric has excellent binding strength.

As a result, the fabric according to this example has excellent rigidity, wear resistance, surface property, fiber supporting property, water drainage property and binding strength, and is firmly woven without undesired movement of wefts.

Example 11

Figure 21:
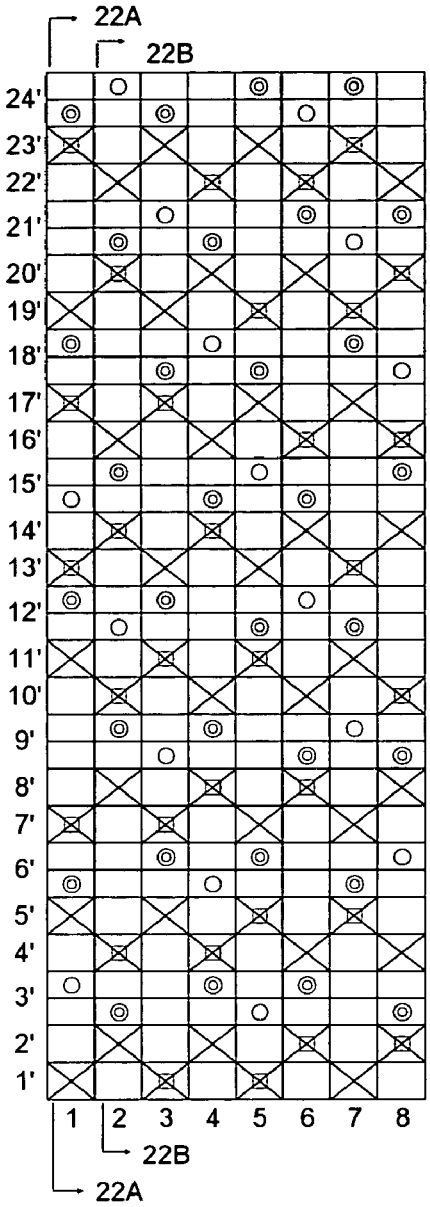
FIG. 21 is a design diagram of an industrial two-layer fabric according to Example 11 of the present invention.

FIG. 21 is a design diagram illustrating a fabric of Example 11 according to the present invention. FIGS. 22A and 22B include cross-sectional views taken along the lines 22A-22A and 22B-22B of the warp pairs 1 and 2 illustrated in the design diagram of FIG. 21 respectively. In the fabrics of the above-described examples, upper and lower layers are woven by a warp binding yarn, while in the fabric of this example, upper and lower layers are woven by two weft binding yarns constituting a pair.

Two weft binding yarns form a pair and function as one weft on the upper side surface. In the upper side layer, a pair of weft binding yarns and an upper surface side weft are arranged alternately and a warp has a 1/1 plain weave design in which it passes over an upper surface side weft or a pair of weft binding yarns, and passes under an upper surface side weft or a weft binding yarn. A weft binding yarn has no lower surface side weft disposed thereunder. Wefts and weft binding yarns are arranged as in Example 10.

A lower surface side weft constituting the lower side surface has a design in which it passes over a lower surface side warp, under a lower surface side warp, over a lower surface side warp, and under five successive lower surface side warps. The complete design of the lower side layer is formed by disposing lower surface side wefts one after another while shifting the design by three warps and four warps successively, more specifically, disposing a first lower surface side weft, disposing a second lower surface side weft adjacent thereto while shifting the design by three warps, disposing a third lower surface side weft adjacent thereto while shifting the design by four warps, and repeating this shifting successively.

A lower surface side warp has a 4/1-3/1-2/1-3/1 design in which it passes over four successive lower surface side wefts, under a lower surface side weft, over three successive lower surface side wefts, under a lower surface side weft, over two successive lower surface side wefts, under a lower surface side weft, over three successive lower surface side wefts and under a lower surface side weft.

A lower surface side weft of the present invention has a portion of passing over a lower surface side warp, passing under a lower surface side warp and then passing over a lower surface side warp. It weaves a lower surface side warp firmly so that the resulting fabric has rigidity. In addition, a crimp of an adequate length which passes under five successive lower surface side warps is formed adjacent to this portion so that wefts are woven firmly without causing undesirable movement. Moreover, in this fabric, the long crimp protrudes on a further lower side, which increases a wear-resistant volume and improves wear resistance. The lower surface side warp in this Example has a 4/1-3/1-2/1-3/1 design. Owing to the absence of a portion of a lower surface side warp passing under a lower surface side weft, over a lower surface side weft and under a lower surface side weft, the lower surface side weft does not protrude to the reverse side and a partially uneven wear of the lower surface side weft therefore does not occur.

The upper side layer has a plain weave design so that the resulting fabric has excellent surface property, fiber supporting property, and rigidity. In addition, since upper and lower layers are woven by a weft binding yarn, the resulting fabric has excellent binding strength.

As a result, the fabric according to this example has excellent rigidity, wear resistance, surface property, fiber supporting property, water drainage property and binding strength, and is firmly woven without undesired movement of wefts.

The industrial two-layer fabric of the present invention is suited as an industrial fabric used under severe conditions such as papermaking fabric and filtering cloth because it has excellent in rigidity, water drainage property, wear resistance, fiber supporting property and yield.

What is claimed is:

1. An industrial two-layer fabric comprises eight pairs of upper surface side warps and lower surface side warps arranged vertically and a plurality of upper surface side weft and lower surface side wefts in a repeating unit wherein:

the eight upper surface side warps and the plurality of upper surface side wefts are woven to form an upper side layer;

the eight lower surface side warps and the plurality of lower surface side wefts being woven to form a lower side layer; and the upper side layer and lower side layer being bound by a pair of two warps or two wefts, further wherein:

each of the lower surface side wefts has a design in which the lower surface side weft passes over one lower surface side warp, passes under one lower surface side warp, passes over one lower surface side warp, and passes under five successive lower surface side warps, and each of the lower surface side warps has a design in which the lower surface side warp passes over four successive lower surface side wefts, passes under one lower surface side weft, passes over three successive lower surface side wefts, passes under one lower surface side weft, passes over two successive lower surface side wefts, passes under one lower surface side weft, passes over three successive lower surface side wefts, and passes under one lower surface side weft.

2. An industrial two-layer fabric according to claim 1, wherein all the lower surface side wefts constituting the lower side layer each has a design in which the lower surface side weft passes over one lower surface side warp, under one lower surface side warp, over one lower surface side warp, and under five successive lower surface side warps, and the lower side layer has a complete design formed by a first lower surface side weft having a weft design, a second lower surface side weft which is adjacent thereto and has the weft design shifted by one warp, a third lower surface side weft which is adjacent thereto and has the weft design shifted by farther four warps, and repeating the shifting successively.

3. An industrial two-layer fabric according to claim 1, wherein all of the lower surface side wefts constituting the lower side layer have designs in which each of the lower surface side wefts passes over one lower surface side warp, under one lower surface side warp, over one lower surface side warp, and under five successive lower surface side warps and the lower side layer has a complete design formed by a first lower surface side weft having a weft design, a second lower surface side weft which is adjacent thereto and has the weft design shifted by three warps, a third lower surface side weft which is adjacent thereto and has the weft design shifted by four warps, and repeating the shifting successively.

4. An industrial two-layer fabric according to claim 1, wherein all of the lower surface side wefts constituting the lower side layer have designs in which each of the lower surface side wefts passes over one lower surface side warp, under one lower surface side warp, over one lower surface side warp and then under five successive lower surface side warps and the lower side layer has a complete design formed by a first lower surface side weft having a weft design a second lower surface side weft which is adjacent thereto and has the weft design shifted by one warp, a third lower surface side weft which is adjacent thereto and has the weft design by further four warps, a fourth lower surface side weft which is adjacent thereto and has the weft design shifted by further five warps, a fifth lower surface side weft which is adjacent thereto and has the weft design shifted by further four warps, and repeating the shifting successively.

5. An industrial two-layer fabric according to claim 1, wherein at least one of the warp pairs composed of an upper surface side warp and a lower surface side warp is a pair of binding warps at least one of which is a warp binding yarn for weaving a upper surface side weft and lower surface side weft to bind the upper side layer and lower side layer while forming a portion of the upper side layer and lower side layer.

6. An industrial two-layer fabric according to claim 5, wherein the pair of binding warps is composed of two warp binding yarns, a warp binding yarn and an upper surface side warp, or a warp binding yarn and a lower surface side warp, and the two warps forming the pair cooperatively form a design corresponding to one warp on the upper side surface and lower side surface.

7. An industrial two-layer fabric according to claim 1, wherein two binding yarns forming a pair and weaving the upper side layer and the lower side layer are weft binding yarns which are located between wefts and weave the upper side warps with the lower side warps while forming a portion of the upper side surface.

8. An industrial two-layer fabric according to claim 1, wherein the upper surface side wefts and the lower surface side wefts are arranged at a ratio of from 1:1 to 2:1.

9. An industrial two-layer fabric according to claim 1, wherein the upper side layer has any one of plain weave, twill weave and sateen weave designs.

* * * * *